US008770987B2

(12) United States Patent
Horikawa

(10) Patent No.: US 8,770,987 B2
(45) Date of Patent: Jul. 8, 2014

(54) CONNECTING TERMINAL STRUCTURE, MANUFACTURING METHOD OF THE SAME AND SOCKET

(75) Inventor: Yasuyoshi Horikawa, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 5 days.

(21) Appl. No.: 13/285,139

(22) Filed: Oct. 31, 2011

(65) Prior Publication Data

US 2012/0108108 A1 May 3, 2012

(30) Foreign Application Priority Data

Nov. 2, 2010 (JP) ..... 2010-246400

(51) Int. Cl.
*H01R 12/00* (2006.01)

(52) U.S. Cl.
USPC ..... 439/71

(58) Field of Classification Search
USPC ..... 439/71, 66, 73, 626
See application file for complete search history.

(56) References Cited

U.S. PATENT DOCUMENTS

| | | | | |
|---|---|---|---|---|
| 6,210,176 | B1 * | 4/2001 | Hsiao | 439/71 |
| 6,730,134 | B2 | 5/2004 | Neidich | |
| 6,884,087 | B2 * | 4/2005 | Searls et al. | 439/66 |
| 6,905,343 | B1 | 6/2005 | Neidich | |
| 6,923,656 | B2 * | 8/2005 | Novotny et al. | 439/66 |
| 6,935,867 | B1 * | 8/2005 | Takai et al. | 439/66 |
| 7,118,401 | B2 * | 10/2006 | McHugh et al. | 439/330 |
| 7,204,701 | B1 * | 4/2007 | Balasingham et al. | 439/73 |
| 7,833,036 | B2 * | 11/2010 | Osato | 439/264 |
| 2002/0111052 | A1 * | 8/2002 | Noda et al. | 439/71 |
| 2004/0072456 | A1 * | 4/2004 | Dozier et al. | 439/83 |

FOREIGN PATENT DOCUMENTS

| | | |
|---|---|---|
| JP | 61-168945 | 7/1986 |
| JP | 2856706 | 2/1999 |
| JP | 11-126800 | 5/1999 |
| JP | 2008-096390 | 4/2008 |
| JP | 4116539 | 7/2008 |
| WO | WO95/14314 | 5/1995 |

OTHER PUBLICATIONS

Office Action dated Apr. 22, 2014 issued with respect to the corresponding Japanese Patent Application No. 2010-246400.

* cited by examiner

*Primary Examiner* — Alexander Gilman
(74) *Attorney, Agent, or Firm* — IPUSA, PLLC

(57) ABSTRACT

A connecting terminal structure includes a plurality of connecting terminals, each including a connecting part to be in contact with an object to be connected at an end of the connecting terminal and a plate-like fixing part at another end of the connecting terminal, a first face of the plate-like fixing part being configured to be electrically connectable; and electronic components, each including at least two electrode terminals, wherein the two electrode terminals of the electronic components are mounted on faces opposite to the first faces of the fixing parts of the connecting terminals.

8 Claims, 18 Drawing Sheets

CONNECTING TERMINAL STRUCTURE, MANUFACTURING METHOD OF THE SAME AND SOCKET

CROSS-REFERENCE TO RELATED APPLICATIONS

This patent application is based upon and claims the benefit of priority of the prior Japanese Patent Application No. 2010-246400 filed on Nov. 2, 2010, the entire contents of which are incorporated herein by reference.

FIELD

The embodiments discussed herein are related to a connecting terminal structure in which connecting terminals are provided in boards, a manufacturing method of the connecting terminal structure, and a socket for electrically connecting an object to be connected such as a semiconductor package to a circuit board.

BACKGROUND

A socket may be provided to electrically connect an object to be connected to a circuit board. The socket may have a connecting terminal to be in contact with the object to be connected. In this case, the connecting terminal is preferably less apt to be affected by noise.

For example, Japanese Laid-open Patent Publication No. 2008-96390 discloses a test socket using a pogo-pin type contact probe (a movable contact probe whose tip end can elongate and contract) as the connecting terminal. According to a technique disclosed in Japanese Laid-open Patent Publication No. 2008-96390, an inductance can be canceled out by providing a capacitor between the adjacent pogo-pin type contact probes. With the technique, the impedance of the contact probe in which the capacitor is provided may be decreased to thereby reduce the noise in the contact probes.

For example, Japanese Patent No. 2856706 discloses a CPU socket (a PGA socket) in which through holes as many as the pins of a LSI for a CPU are provided in a multilayer board, contacts (connecting terminals) are inserted into the through holes, contact lead wires connected to the contacts are pulled out of a lower surface of the multilayer board, and the contacts are electrically connected to a stacked capacitor formed of electrode layers and dielectric layers. According to a technique disclosed in Japanese Patent No. 2856706, impedance of the contacts electrically connected to the stacked capacitor is decreased to thereby reduce noise of the contacts.

SUMMARY

According to an aspect of the embodiment, a connecting terminal structure includes a plurality of connecting terminals, each of the terminals including a connecting part to be in contact with an object to be connected at an end of the connecting terminal and a plate-like fixing part at another end of the connecting terminal, a first face of the plate-like fixing part being configured to be electrically connectable; and electronic components including electrode terminals, wherein the at least two electrode terminals of the electronic components are mounted on faces opposite to the first faces of the fixing parts of the connecting terminals.

The object and advantages of the invention will be realized and attained by means of the elements and combinations particularly pointed out in the appended claims.

It is to be understood that both the foregoing general description and the following detailed description are exemplary and explanatory and are not restrictive of the invention as claimed.

DESCRIPTION OF EMBODIMENTS

As described previously, there are the technique disclosed in Japanese Laid-open Patent Publication No. 2008-96390 that the inductance is canceled out by providing the capacitor between the adjacent pogo-pin type contact probes, the impedance of the contact probe in which the capacitor is provided is decreased, and the noise in the contact probes is reduced; and the other technique disclosed in Japanese Patent No. 2856706 that the impedance of the contacts electrically connected to the stacked capacitor is decreased to thereby reduce noise of the contacts.

However, the overall lengths of the pogo-pin type contact probes are long enough to increase the inductance. Therefore, a capacitor having a large capacitance corresponding to the value of the inductance may be provided between adjacent contact probes in order to reduce the noise with the technique disclosed in the Japanese Unexamined Patent Application Publication No. 2008-96390.

Therefore, if the distance between the contact probes becomes short in order to achieve high density, it becomes difficult to provide capacitors having appropriate capacitances.

With the technique disclosed in Japanese Patent No. 2856706, the electrode layers and the dielectric layers are made to form the stacked type capacitor inside a board used as a socket. Therefore, the internal structure becomes complicated and the manufacturing cost increases.

Preferred embodiments of the present invention are explained with reference to accompanying drawings. The same reference symbols may be used for the same constituent parts and repeated explanation of these may be omitted.

In the following embodiments and modified examples of the embodiments, cases where shapes of a semiconductor package and a substrate are rectangular in their plan views are described. However, the plan views of the semiconductor package and the substrate are not limited thereto and may be arbitrary shapes.

First Embodiment (Structure of Socket of First Embodiment)

Figure 1:
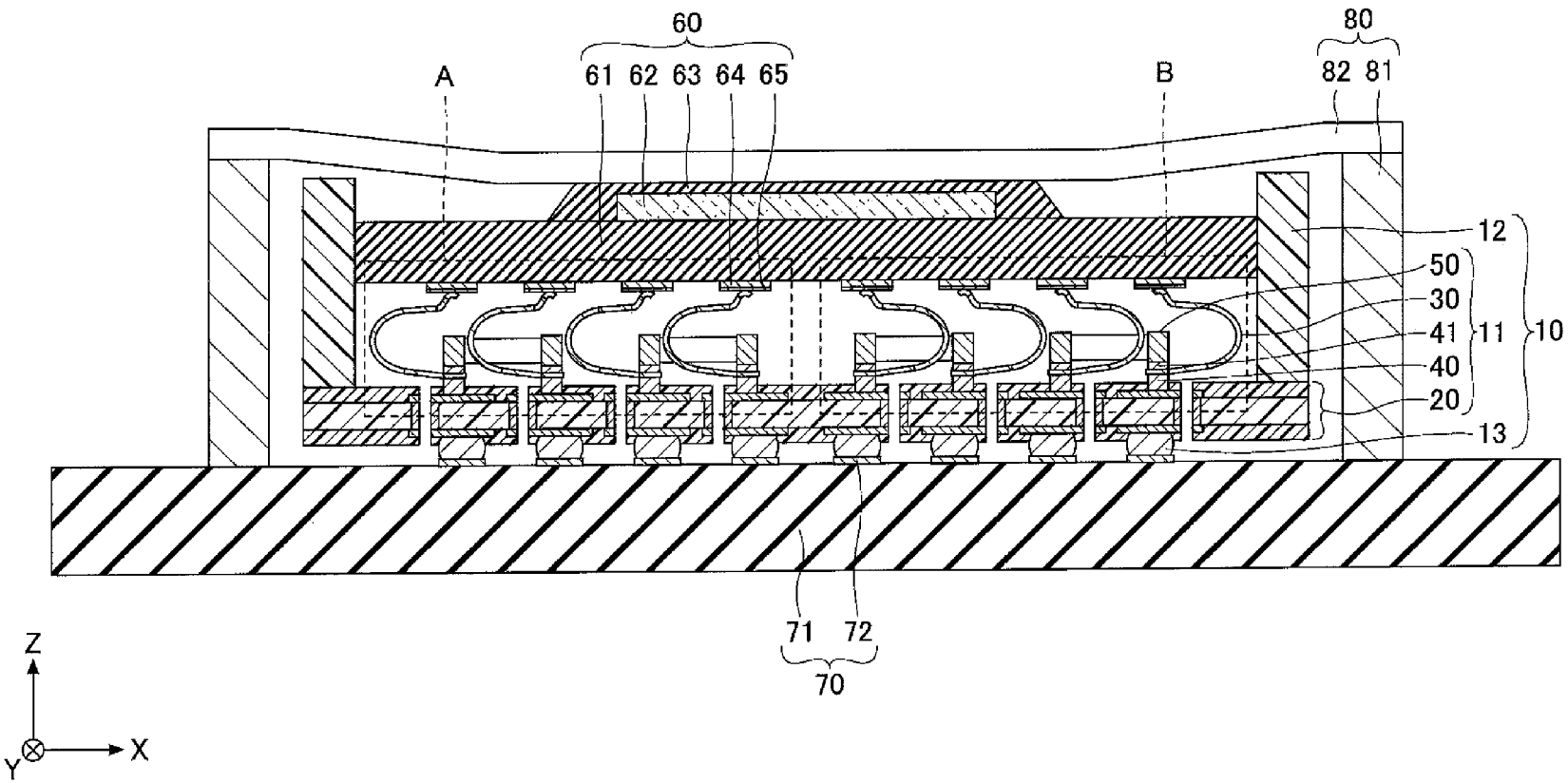
FIG. 1 is a cross-sectional view of an exemplary socket of a First Embodiment.
Figure 2:
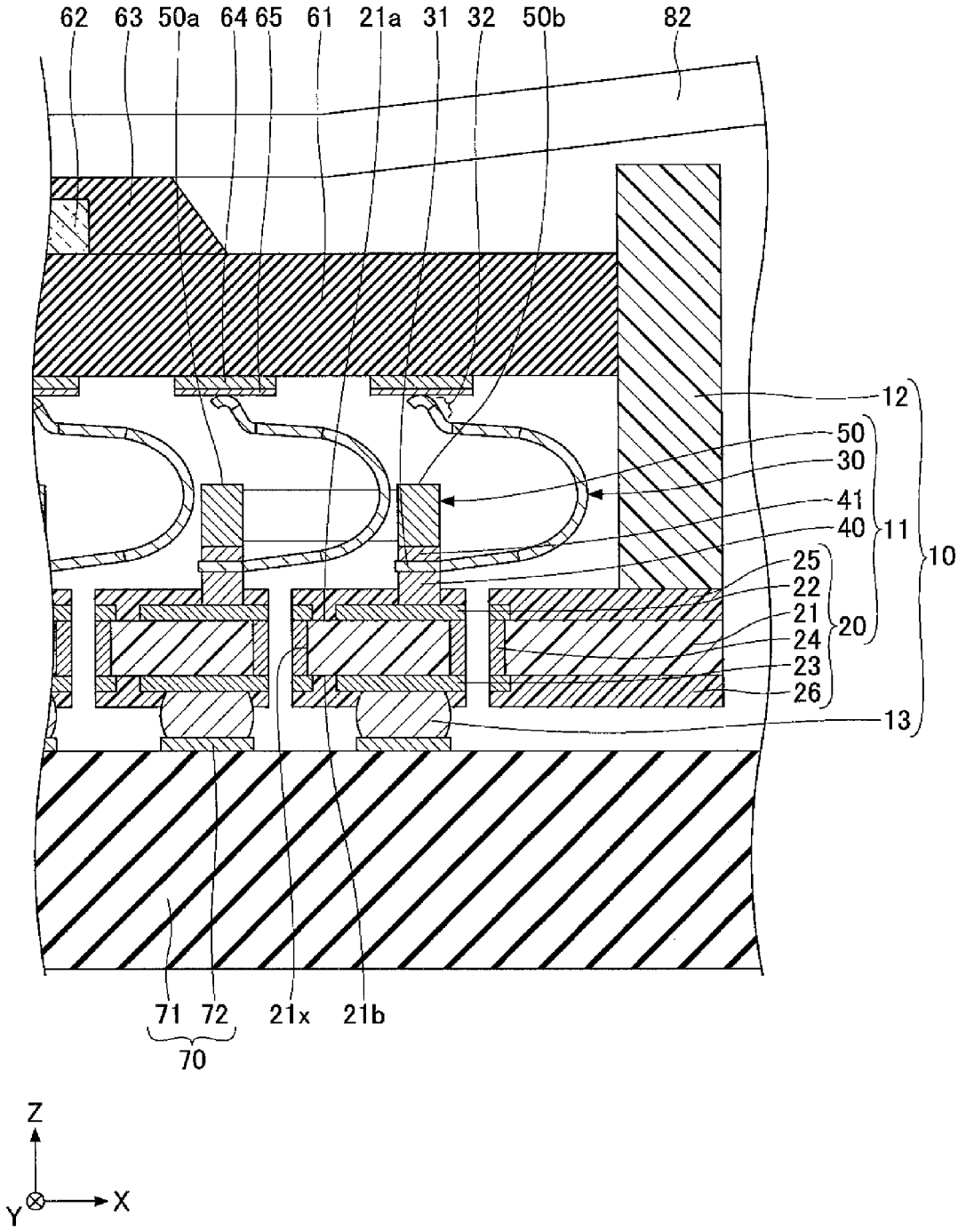
FIG. 2 is an enlarged cross-sectional view illustrating a part of the exemplary socket illustrated in FIG. 1.
Figure 3:
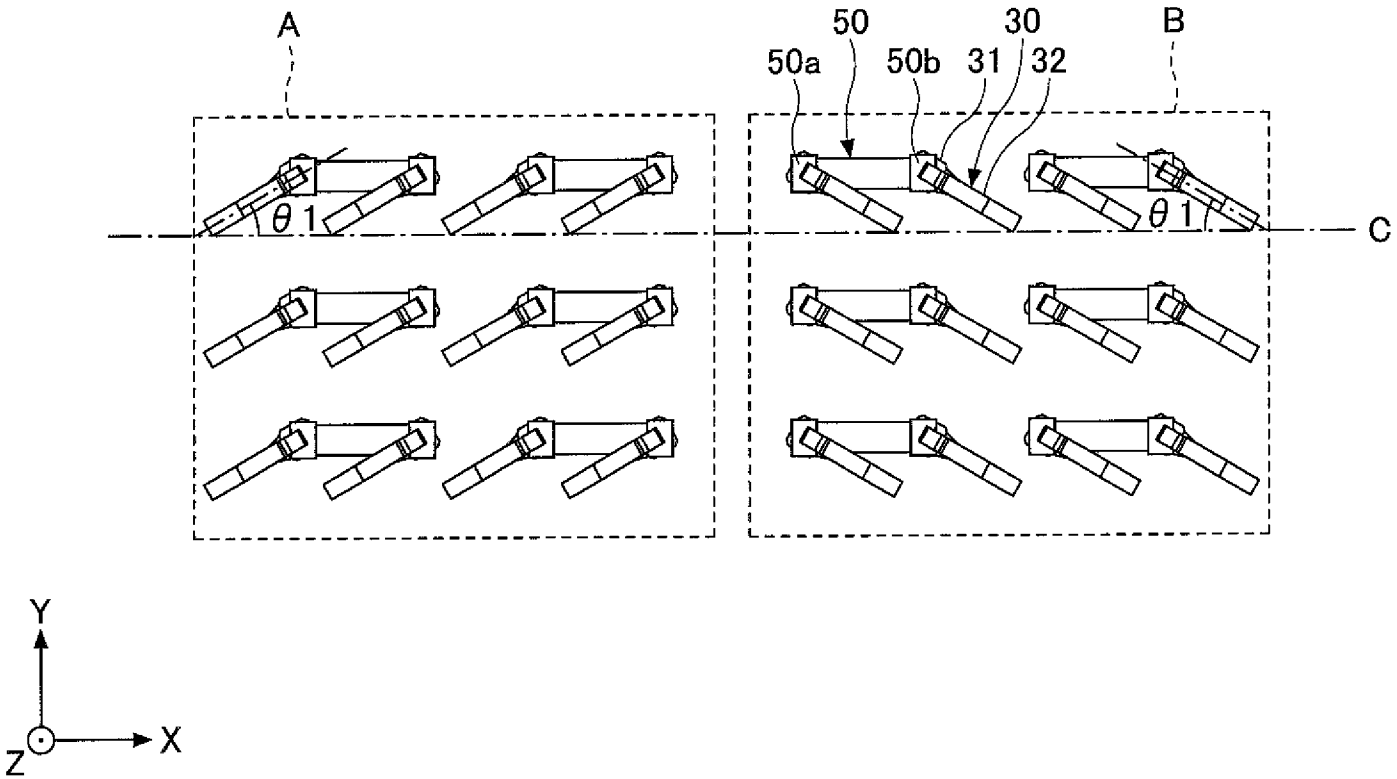
FIG. 3 is an enlarged plan view illustrating a part of the exemplary socket illustrated in FIG. 1.

FIG. 1 is a cross-sectional view of the exemplary socket of the First Embodiment. FIG. 2 is the enlarged cross-sectional view illustrating a part of the socket illustrated in FIG. 1. FIG. 3 is the enlarged plan view illustrating a part of the exemplary socket illustrated in FIG. 1. Referring to FIG. 1 to FIG. 3, a direction X is parallel to a line passing through electrodes 50*a* and 50*b* of electronic components 50, a direction Y is perpendicular to the direction X and parallel to a first principal face 21*a* of a main body 21 of a board 20, and a direction Z is perpendicular to the first principal face 21*a* of the main body 21 of the board 20. FIG. 1 and FIG. 2 illustrate a cross section parallel to an X-Z plane illustrated in FIG. 3. FIG. 3 illustrates only the connecting terminals 30 and the electronic components 50 and other portions are omitted.

Referring to FIG. 3, because the connecting terminals 30 are not parallel to the directions X and Y, cross-sectional shapes along an X-Z plane do not sufficiently depict the connecting terminals 30. For convenience, the cross-sectional shapes of the connecting terminals 30 in their longitudinal directions are embedded and illustrated in FIG. 1 and FIG. 2.

Referring to FIG. 1 to FIG. 3, a socket 10 includes a connecting terminal structure 11, a positioning portion 12 and bumps 13. Referring to FIG. 1 to FIG. 3, a reference symbol 60 designates a semiconductor package being an object to be connected, a reference symbol 70 designates a circuit board such as a motherboard and a reference symbol 80 designates a casing. The semiconductor package 60 is electrically connected to the circuit board 70 via the socket 10. With the First Embodiment, although the semiconductor package 60 is exemplified as the object to be connected, the object to be connected may be a circuit board having no semiconductor chip on it or the like.

(Connecting Terminal Structure 11)

First, the connecting terminal structure 11 of the socket 10 is described. The connecting terminal structure 11 includes the board 20, the connecting terminals 30, joining parts 40, joining parts 41 and the electronic components 50.

The board 20 of the connecting terminal structure 11 includes the main body 21, the first conductive layer 22 formed on the first principal face 21*a* of the main body 21, a second conductive layer 23 formed on a second principal face 21*b* of the main body 21, a via wiring 24 formed inside a through hole 21*x* penetrating the first principal face 21*a* of the main body 21 and the second principal face 21*b* of the main body 21, a first solder resist layer 25 formed above the first principal face 21*a* of the main body 21 of the board 20 and having an opening portion from which a part of the first conductive layer 22 is exposed to the outside, and a second solder resist layer 26 formed below the second principal face 21*b* of the main body 21 of the board 20 and having an opening portion from which a part of the second conductive layer 23 is exposed to the outside.

For example, the through holes 21*x* may be shaped like a circle. Many through holes 21*x* may penetrate the substrate 20. However, the through holes 21*x* may not physically segment (dissever) the substrate 20.

The first conductive layer 22 is electrically connected to the second conductive layer 23 via the via wiring 24. The via wiring 24 may fill in the through hole 21*x*.

This is because, referring to FIG. 2, the first solder resist layer 25 insulates adjacent portions of the first conductive layer 22 at the first principal face 21*a* to prevent short-circuiting between electrode terminals 50*a* and 50*b* of the electronic component 50. Further, the second solder resist layer 26 insulates adjacent portions of the second conductive layer 23 at the second principal face 21*b* to prevent short-circuiting between electrode terminals 50*a* and 50*b* of the electronic component 50.

A portion of the first conductive layer 22 exposed from an opening portion of the first solder resist layer 25 functions as a pad connected to a fixing part 31 of the connecting terminal 30. A portion of the second conductive layer 23 exposed from an opening portion of the second solder resist layer 26 functions as a pad connected to the circuit board 70. The first principal face 21*a* of the main body 21 of the board 20 may be simply referred to as a principal face and the second principal face 21*b* of the main body 21 of the board 20 may be simply referred to as an opposite face.

The main body 21 of the board 20 functions as a base body for fixing the connecting terminal 30, for example, a flexible film substrate made of a polyamide resin, liquid-crystalline polymer and so on. The main body 21 of the board 20 may be a rigid board formed by impregnating glass cloth with an epoxy resin such as FR4. The thickness of the main body 21 of the board 20 is, for example, about 50 to about 400 μm, preferably about 100 μm.

The materials of the first conductive layer 22, the second conductive layer 23 and the via wiring 24 are, for example, copper (Cu) or the like. The thicknesses of the first conductive layer 22 and the second conductive layer 23 are, for example, about 5 to about 10 μm. The first conductive layer 22, the second conductive layer 23, and the via wiring 24 may be formed by various wiring forming methods such as a semi-additive method and a subtractive method.

Photosensitive insulating resin and so on can be used as the materials of the first solder resist layer 25 and the second solder resist layer 26. The first solder resist layer 25 and the second solder resist layer 26 having the opening portions may be formed by, for example, a photolithography method.

The connecting terminals 30 of the connecting terminal structure 11 are conductive members having features of the springs 30 causing flex and extend motions. The fixing part 31 at an end of the connecting terminal 30 is electrically and mechanically connected to the first conductive layer 22 via the joining part 40. A connecting part 32 at the other end of the connecting terminal 30 is in contact with a rare metal layer 65 of a semiconductor package 60 to be described below so that the connecting part 32 can be separated from the rare metal layer 65 of a semiconductor package 60 to be described below. Said differently, the connecting part 32 is not fixed to the rare metal layer 65. Thus, the connecting terminal 30 is electrically connected to the rare metal layer 65.

A group of the connecting terminals 30 arranged on a region A illustrated in FIG. 1 and another group of the connecting terminals 30 arranged on a region B illustrated in FIG. 1 substantially face each other. With the arrangement, when the connecting terminals 30 are pushed in the direction Z, counter force generated in lateral directions (directions other than the direction Z) can be relaxed or canceled out. Especially, this structure is advantageous when the number of the connecting terminals 30 are great. However, if the number of the connecting terminals 30 is vanishingly small enough to ignore counter force generated in the lateral directions (directions other than the direction Z), it may be possible to arrange the group of the connection terminals 30 in the region A and the other group of the connection terminals 30 in the region B in the same direction without facing each other.

Referring to the plan view of the socket 10 of FIG. 3, the group of the connecting terminals 30 in the region A is arranged with an angle θ1 relative to an arranging direction C (the direction X) in the counterclockwise direction, and the other group of the connecting terminals 30 in the region B is arranged with an angle θ1 relative to an opposite direction to the arranging direction C (the opposite direction to the direction X) in the clockwise direction. Said differently, referring to the plan view of FIG. 3, the longitudinal directions of the connecting terminals 30 slant relative to the direction connecting upper surfaces of the electrode terminals 50*a* and 50*b*. However, with the First Embodiment, the group of the connecting terminals 30 in the region A and the other group of the connecting terminals 30 in the region B substantially face each other. Therefore, as illustrated in FIG. 3, the group of the connecting terminals 30 in the region A and the other group of the connecting terminals 30 in the region B slant relative to the direction X in different directions and are arranged in different directions. The angle θ1 is predetermined to be, for example, about 25° to about 35°.

Referring to FIG. 3, the group of the connecting terminals 30 in the region A and the other group of the connecting terminals 30 in the region B are arranged in symmetry with respect to a line parallel to the direction Y. However, the group of the connecting terminals 30 in the region A and the other group of the connecting terminals 30 in the region B may be differently arranged. It is possible to change the positions of the connecting terminals 30 in the region A illustrated in FIG. 3 in symmetry with respect to a line parallel to lines connecting the electrode terminals 50*a* of the electronic components to the electrode terminals 50*a* of the same electronic components.

As described, by slanting the connecting terminals 30 relative to the arranging direction C of the connecting terminals 30, it is possible to arrange a larger number of connecting terminals 30 in a unit area in comparison with a case where the connecting terminals 30 are arranged parallel to the arranging direction C. With this, it becomes possible to connect an object to be connected (e.g., the semiconductor package 60) in which pads (e.g., the rare metal layers 65) are arranged with narrow pitches of about 0.4 mm. By slanting the connecting terminals 30 relative to the arranging direction C of the connecting terminals 30, the electronic components 50 are mounted on the fixing parts 31 of the connecting terminals 30. A detailed structure of the connecting terminals 30 is described later.

The joining parts 40 of the connecting terminal structures 11 are formed around the opening portions of the first solder resist layers 25 and electrically and mechanically connect the fixing parts 31 of the connecting terminals 30 to the first conductive layers 22. The material of the joining parts 40 is a conductive material such as solder and a conductive resin paste such as an Ag paste. When the joining part 40 is made of solder, the solder may be, for example, an alloy containing Pb, an alloy containing Sn and Cu, an alloy containing Sn and Ag, an alloy containing Sn, Ag, and Cu, and so on.

The joining parts 41 of the connecting terminal structure 11 electrically and mechanically connect the fixing parts 31 of the connecting terminals 30 to the electrode terminals 50*a* and 50*b* of the electronic components 50. The material of the joining parts 41 may be the same as that of the joining parts 40.

The electronic components 50 of the connecting terminal structure 11 are mounted on the fixing parts 31 of the connecting terminals 30 which are adjacent to each other in the direction X while the electronic components 50 are not directly in contact with the board 20. Specifically, the electrode terminals 50*a* and 50*b* of the electronic components 50 are mounted on second faces 31*b* of the fixing parts 31 of the adjacent connecting terminals 30 (see FIG. 4) via the joining parts 41. However, the electronic components 50 may be mounted on the fixing parts 31 of the connecting terminals 30 which are adjacent to each other in the direction Y without directly being in contact with the board 20 after turning the electric components 50 by 90 degrees on the X-Y plane.

The shape of the electronic components 50 is, for example, a rectangular solid. The electronic components 50 have the electrodes 50*a* and 50*b* one on each end in the longitudinal direction. The electronic component 50 is, for example, a capacitor. One of the electrode terminals 50*a* and 50*b* becomes the positive electrode, and the other of the electrode terminals 50*a* and 50*b* becomes the negative electrode. For example, the positive electrodes of the electronic components 50 are connected to a power line via the connecting terminals, and the negative electrodes of the electronic components 50 are connected to a GND line having a reference potential via the connecting terminals 30. The electronic components may be chip capacitors of a so-called 1005 type having a length of 1.0 mm, a width of 0.5 mm and a height of 0.5 mm. The electronic component 50 may be shaped like an array including plural capacitors of the so-called 1005 type and so on.

The electronic components 50 are mounted on regions where the electronic components 50 are not in contact with the contacting parts 32 even if the contacting parts 32 move with the property of a spring causing flex and extend motions provided in the connecting terminals 30. Said differently, the heights of the electronic components 50 are sufficiently lower than the heights H of the connecting terminals 30 illustrated in FIG. 4.

By installing the capacitors as the electronic components 50 on the fixing parts 31 of the connecting terminals 30, it is possible to reduce the impedances of wirings connected to the connecting terminals 30 to thereby stabilize the power source.

Further, it is possible to make the wiring length from the semiconductor package 60 to the capacitor as the electronic component 50 short. Furthermore, because an additional wiring for mounting the capacitor as the electronic component 50 does not exist, corresponding inductance and resistance do not additionally occur. With this, the transmission capability of a high speed signal between the semiconductor package 60 and the circuit board 70 such as a motherboard can be improved.

Even if the capacitors as the electronic components 50 are mounted on the fixing parts 31 of the adjacent connecting terminals 30, the overall height of the socket 10 remains unchanged thereby not spoiling the low height profile of the socket 10 having the electronic components 50. Furthermore, because the capacitors as the electronic components 50 can be mounted on the fixing parts 31 of the adjacent connecting terminals 30 with a simple structure, the manufacturing cost of the socket 10 can be prevented from increasing.

The capacitors as the electronic components 50 may be installed in an arbitrary portion on the fixing parts 31 of the connecting terminals 30 and not always installed on the entire faces of second faces 31*b* of the connecting terminals 30. The electronic components 50 may be resistors or inductors instead of the capacitors. The electrode terminals 50*a* and 50*b* of the electronic component 50 may be connected to a signal line and so on via the connecting terminals 30 instead of the power source line and the GND line having the reference potential. For example, it is possible to remove or reduce noise in a signal line when a capacitor as the electronic component 50 is mounted by connecting one of the electrode terminals 50*a* and 50*b* to the signal line via the connecting terminal 30 and connecting the other one of the electrode terminals 50*a* and 50*b* to the GND line having the reference potential via the connecting terminal 30. Moreover, it is possible to pull up the signal line when a resistor as the electronic component 50 is mounted on the fixing parts 31 by connecting one of the electrode terminals 50*a* and 5*b* to the signal line via the connecting terminal 30 and connecting the other one of the electrode terminals 50*a* and 50*b* to the power source line.

(Positioning Portion 12)

Next, the positioning portion 12 of the socket 10 is described. The positioning portion 12 has a frame-like shape (an architrave-like shape) in a plan view. For example, the primary component of the positioning portion 12 is an epoxy resin and so on. The bottom face of the positioning portion 12 is fixed to an outer edge portion of the first solder resist layer 25 formed on the first principal face 21*a* of the main body 21 of the board 20 by bonding and so on. The positioning portion 12 may be mechanically fixed to the board 20 by screws and so on. The shape of a space surrounded by the inner side surfaces of the positioning portion 12 in its plan view is substantially the same as the shape of a substrate 61 of the semiconductor package 60 in its plan view. Therefore, the semiconductor package 60 can be inserted into the space surrounded by the inner side surfaces of the positioning portion 12.

The inner side surfaces of the positioning portion 12 are in contact with the side surfaces of the substrate 61 of the inserted semiconductor package 60 to position the semiconductor package 60 relative to the socket 10. Thus, the rare metal layers 65 are in contact with the connecting parts 32 of the connecting terminals 30 of the socket 10. The positioning portion 12 also has a function of reinforcing the strength of the board 20 in addition to positioning the semiconductor package 60 relative to the socket 10.

The positioning portion 12 may not be included in the socket 10. For example, the socket 10 may be structured to position the semiconductor package 60 with a frame 81 of the casing 80 to be described below without providing the positioning portions 12.

(Bump 13)

Next, the bumps 13 of the socket 10 are described. The bumps 13 are formed in the opening portions of the second solder resist layer 26 to electrically and mechanically connect the second conductive layer 23 of the board 20 to conductive pads 72 of the circuit board 70. The material of the bumps 13 is a conductive material such as solder and a conductive resin paste such as an Ag paste. When the bump 13 is made of solder, the solder may be, for example, an alloy containing Pb, an alloy containing Sn and Cu, an alloy containing Sn and Ag, an alloy containing Sn, Ag, and Cu, and so on.

The bump 13 is not indispensable to the socket 10. For example, the bumps 13 may not be provided in the socket 10, and bumps made of solder, a conductive resin bond and so on may be formed on the conductive pads 72 of the circuit board 70.

(Semiconductor Package 60, Circuit Board 70 and Casing 80)

Next, the semiconductor package 60 as an object to be connected, the circuit board 70 such as a motherboard and the casing 80 are described. The semiconductor package 60 as the object to be connected includes the substrate 61, a semiconductor chip 62, a sealing resin 63, a conductive layer 64, and a rare metal layer 65. The substrate 61 is formed by laminating a substrate body containing an insulation resin, an insulating layer, wiring patterns, via wirings (not illustrated) and so on. The semiconductor chip 62 containing silicon and so on is mounted on one side of the substrate 61, and the conductive layer 64 as a part of the wiring pattern is formed on the other surface of the substrate 61.

The material of the conductive layer 64 is, for example, copper (Cu). The thickness of the conductive layer 64 may be about 5 μm to about 10 μm. The semiconductor chip 62 may be mounted on the substrate 61 by flip-chip bonding on the substrate 61 and sealed by the sealing resin 63 made of an insulating resin. The sealing resin 63 may be provided to expose a back surface of the semiconductor chip 62 and a radiator plate made of, for example, copper (Cu) may be positioned on the back surface of the semiconductor chip 62.

The rare metal layer 65 is laminated on the upper surface of the conductive layer 64. The conductive layer 64 and the rare metal layer 65 are pads arranged in a grid-like shape on the other surface of the substrate 61. The semiconductor package 60 is a so-called Land Grid Array (LGA), and the socket 10 is a so-called socket for LGA.

For example, the rare metal layer 65 may contain a noble metal such as gold (Au) and palladium (Pd). The rare metal layer 65 may be formed by electroless plating or the like. As an under layer of the gold (Au) layer, a nickel (Ni) layer, a Ni/Pd layer (a metallic layer formed by laminating a Ni layer and a Pd layer in this order) or the like may be provided.

The rare metal layers 65 are provided to improve reliability of connecting the conductive layers 64 to the connecting terminals 30. The rare metal layers 65 are thicker and larger than those of an ordinary plating layer in order to stabilize a contact resistance between the connecting terminals 30 and the conductive layers 64. The thicknesses of the gold plating layers ordinarily provided to improve the reliability of connecting conductive layers to solder balls are about 0.05 μm or less. On the contrary, the thicknesses of the rare metal layers are about 0.4 μm, which are about 8 times or more of the thicknesses of ordinarily provided gold plating layers.

The circuit board 70 (the motherboard or the like) includes a main body 71 of the circuit board 70 and the conductive pads (pads) 72. The conductive pads 72 are formed on one surface of the main body 71 of the circuit board 70. The main body 71 of the circuit board 70 may be an insulating resin such as a glass cloth impregnated with an epoxy resin and so on. The material of the conductive pads 72 is, for example, copper (Cu).

The casing 80 includes the frame 81 and a lid 82. The frame 81 is a frame-like (architrave-like) member in its plan view provided outside an outer side surface of the positioning portion 12. The material of the frame 81 is a metal, a resin and so on having rigidity. The frame 81 is fixed to the upper surface of the circuit board 70 by bolts (not illustrated) penetrating the circuit board 70.

For example, the lid 82 has a substantially rectangular shape or a substantially frame-like shape (an architrave-like shape) in its plan view and is made of a metal, a resin and so on. The lid 82 is attached to the upper surface of the frame 81 so as to be rotatable around one end of the upper surface of the frame 81 and has a lock mechanism in the other end of the upper surface of the frame 81. By fixing an outer edge portion of the lid 82 so as to be fixed (locked) to the upper surface of the frame 81 under states of FIG. 1 and FIG. 2, the lid 82 pushes the semiconductor package 60 toward the circuit board 70 to thereby move the semiconductor package 60 on the side of the circuit board 70.

With this, the connecting terminals 30 of the socket 10 are pushed with force and compressed in the direction of Z to generate a predetermined spring force. Therefore, the rare metal layers 65 of the semiconductor package 60 are in contact with the connecting parts 32 of the connecting terminals 30. The semiconductor package 60 is electrically connected to the circuit board 70 via the socket 10. However, by releasing the lid 82 from locking, the semiconductor package 60 becomes detachable from the socket 10.

The lid 82 may be separable from the frame 81. In this case, for example, the lid 82 may be fixed to the frame 81 while the semiconductor package 60 is pushed with pressure from the upper side of the semiconductor package 60 by the lid 82.

Figure 4:
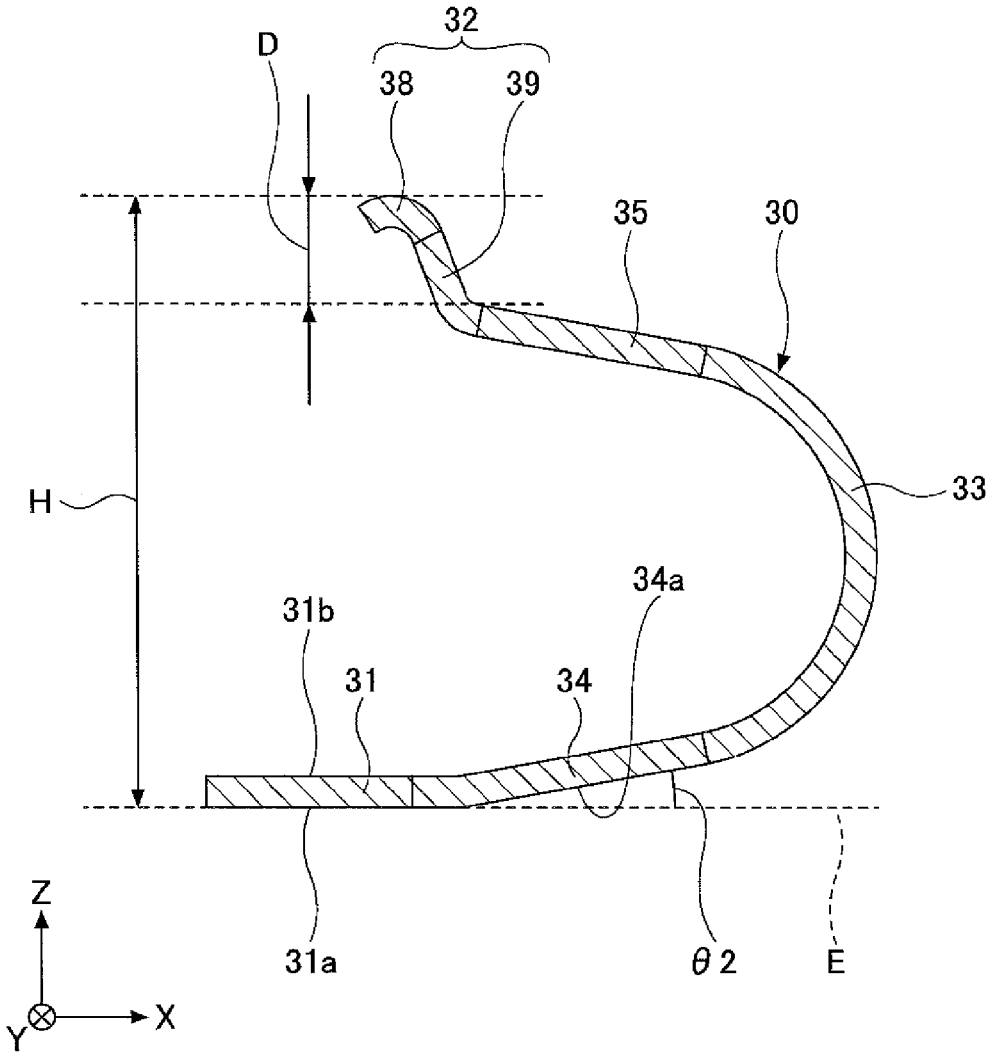
FIG. 4 is an exemplary cross-sectional view of a connecting terminal of the First Embodiment.

Referring to FIG. 4, a detailed structure of the connecting terminal 30 is described. FIG. 4 is an exemplary cross-sectional view of the connecting terminal of First Embodiment. Referring to FIG. 4, the connecting terminal 30 is a conductive member having a spring property causing flex and extend motions. The connecting terminal 30 includes the fixing part 31, the connecting part 32, a spring part 33, a first supporting part 34, and a second supporting part 35.

The fixing part 31 is formed in one end of the connecting terminal 30. The fixing part 31 is like a plate. The thickness of the fixing part in the direction Z may be about 0.08 mm. The width of the fixing part 31 in the direction Y may be about 0.04 mm. The length of the fixing part 31 in the direction X may be about 0.4 mm.

First faces 31*a* of the fixing parts 31 are electrically and mechanically connected to the surfaces of the first conductive layer 22 of the board 20 via the joining parts 40. The second faces 31*b* of the fixing parts 31 are electrically and mechanically connected to the electrode terminals 50*a* and 50*b* of the electronic components 50 via the joining parts 41.

The connecting parts 32 are formed at the other ends of the connecting terminals 30 so as to face the fixing parts 31. The connecting parts 32 are electrically connected to the fixing parts 31 via the spring parts 33, the first supporting parts 34 and the second supporting parts 35. The connecting parts 32 include connecting parts 38 and standing parts 39. The thicknesses of the connecting parts 32 may be about 0.08 mm. The widths of the connecting parts 32 in the direction Y may be about 0.2 mm. The spring parts 33, the first supporting parts 34 and second supporting parts 35 may be referred to as curved portions.

The contacting parts 38 are in contact with the pads of the objects to be connected (for example, the rare metal layers 65 of the semiconductor package 60). The contacting parts 38 are rounded and move mainly in the direction Z when the connecting terminals 30 are pushed with pressure. As described, by rounding the connecting parts 38, it is possible to prevent the rare metal layers 65 from being damaged by the contact parts 38 when the contacting parts 38 are pushed with pressure so as to be in contact with the rare metal layers 65.

The contacting parts 38 are in contact with the rare metal layers 65 or the like after the connecting parts 32 are moved in a direction of approaching the fixing part 31 (the direction Z) of the connecting parts 32 with deformation of the spring parts 33 when the semiconductor package 60 pushes the connecting parts 32. With this, when the rare metal layers 65 and so on are in contact with the connecting parts 32, the connecting parts 32 do not largely move in a direction parallel to the lower surfaces of the rare metallic layers 65 to thereby enable to arrange the rare metal layers 65 at narrow pitches. The pitches of the rare metal layers 65 and so on (pitches of the contacting parts 38) may be about 0.4 to about 1.5 mm.

One end of the standing part 39 is integrally formed with the second supporting part 35. The other end of the standing part 39 is integrally formed with the contacting part 38. The standing parts 39 protrude in directions from the second supporting parts 35 to the rare metal layers 65 (directions of separating from the fixing parts 31).

As described, the standing parts 39 are provided between the contacting parts 38 and the second supporting parts 35 so as to be integrally formed with the contacting parts 38 and the second supporting parts 35. Further, the standing parts 39 protrude in directions from the second supporting parts 35 to the rare metal layers 65 in directions of separating from the fixing parts 31 to thereby provide the following effects. Said differently, it becomes possible to prevent the rare metal layers 65 and so on from being in contact with the second supporting parts 35 due to the deformation of the spring parts 33 when the semiconductor package 60 and so on pushes the contacting parts 38. Thus, it is possible to prevent the connecting terminal 30 and the rare metal layer 65 and so on from being damaged.

The standing distance D, which is measured from a connecting part between the second supporting part 35 and the standing part 39, of the connecting part 32 under the state in which the rare metal layers 65 are not in contact with the connecting parts 32 are, for example, 0.3 mm.

The spring parts 33 are arranged between the first supporting part 34 and the second supporting part 35 and integrally formed with the first supporting part 34 and the second supporting part 35. The spring part 33 curves (for example, a C-like shape) and has a spring property causing flex and extend motions.

The spring part 33 is provided to make the connecting part 32 contact the rare metal layer 65 and so on without fixing the connecting part 32 to the rare metal layer 65 and so on by holding the connecting part 32 facing the rare metal layer 65 when the connecting part 32 is pushed downward by the semiconductor package 60. The width of the spring part 33 in the direction Y and the thickness of the spring part 33 may be the same as the width of the connecting parts 32 and the thickness of the connecting parts 32.

In the connecting terminals 30 of a First Embodiment of the present invention, the first supporting parts 34, the spring parts 33, the second supporting parts 35 and the connecting parts 32 integrally function as springs. The constants of springs of the connecting terminals 30 corresponding to the first supporting parts 34, the spring parts 33, the second supporting parts 35 and the connecting parts 32 are, for example, 0.6 to 0.8 N/mm.

The first supporting parts 34 are arranged between the spring parts 33 and the fixing parts 31. One end of the first supporting part 34 is integrally formed with one end of the spring part 33. The other end of the first supporting part 34 is integrally formed with the fixing part 31. The first supporting part 34 is shaped like a plate.

The first supporting parts 34 are formed so that an angle θ2 formed between a plane E including the first face 31*a* of the fixing part 31 and a face 34*a* of the first supporting part 34 opposite to the board 20 becomes an acute angle. The angle is, for example, 5° to 15°.

By making the angle θ2 the acute angle, it becomes possible to prevent a contact between the board 20 and the first supporting part 34 caused by deformation of the spring part 33 caused by pushing the contacting part 38 with the semiconductor package 60 and so on. Therefore, it is possible to prevent the connecting terminal 30 and the board 20 from being damaged. The width of the first spring part 34 in the direction Y and the thickness of the first supporting part 34 may be the same as the width of the connecting parts 32 and the thickness of the connecting parts 32.

The second supporting parts 35 are arranged between the spring parts 33 and the connecting parts 32. One end of the second supporting part 35 is integrally formed with the other end of the spring part 33. The other end of the second supporting part 35 is integrally formed with the standing part 39 of the connecting part 32. The second supporting part 35 is shaped like a plate. The width of the second spring part 35 in the direction Y and the thickness of the second supporting part 35 may be the same as the width of the connecting parts 32 and the thickness of the connecting parts 32.

Referring to FIG. 4, the height H of the connecting terminal 30 under a state where the connecting part 32 of the connecting terminal 30 is not pushed with pressure may be, for example, about 1 mm to about 2 mm, preferably about 1.6 mm.

(Structure of the Socket of First Embodiment)

Referring to FIG. 5 to FIG. 14, a manufacturing method of the socket 10 is described. FIG. 8 and FIG. 10 to FIG. 13 are upended relative to FIG. 1 to FIG. 3 (up-side down).

Figure 5:
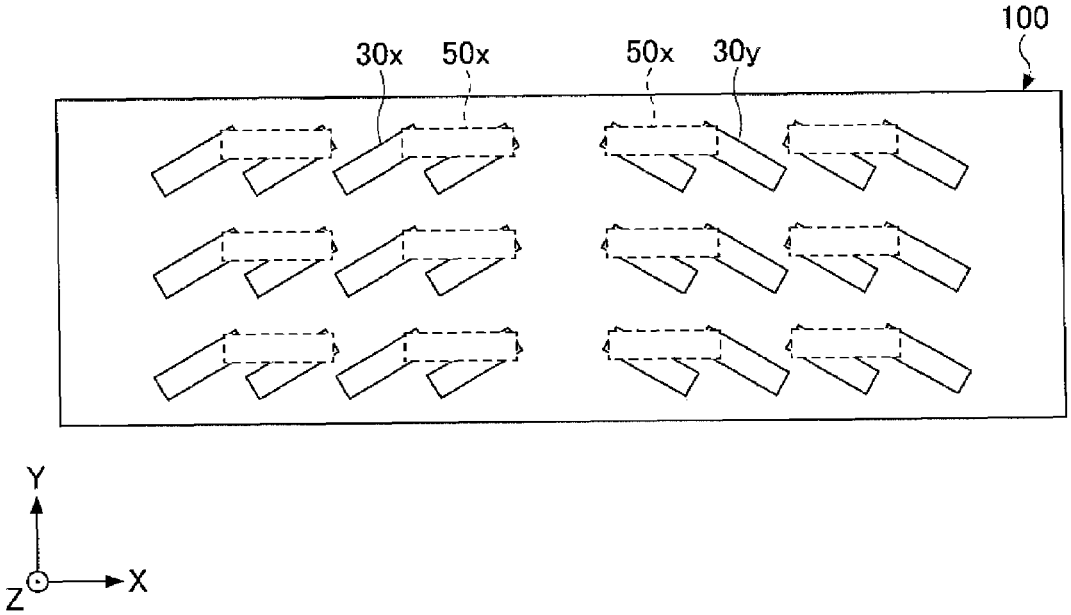
FIG. 5 illustrates a first step of an exemplary manufacturing process of the exemplary socket of the First Embodiment.
Figure 6:
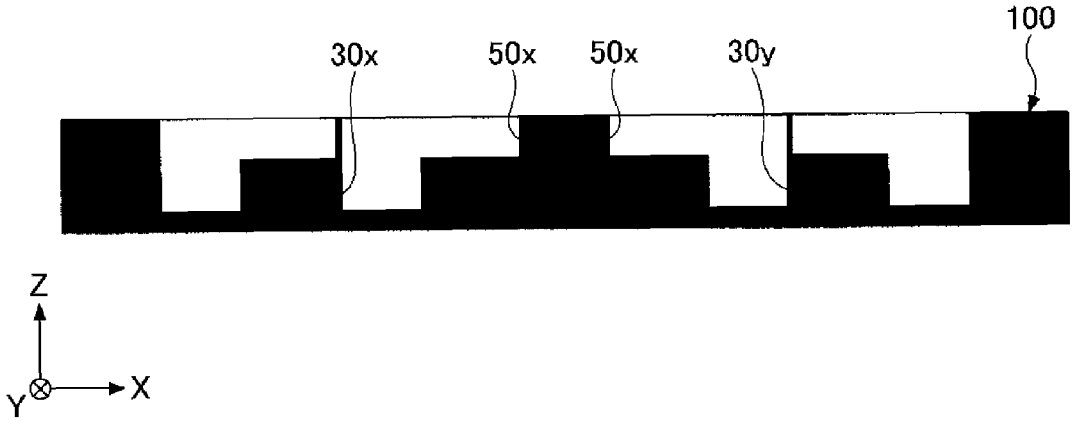
FIG. 6 illustrates a second step of the exemplary manufacturing process of the exemplary socket of the First Embodiment.

In the processes illustrated in FIG. 5 (plan view) and FIG. 6 (cross-sectional view), a jig 100 for arranging plural connecting terminals 30 and electronic components 50 is prepared. Grooves 30*x* for arranging the connecting terminals 30 corresponding to the region A, grooves 30*y* for arranging the connecting terminals 30 corresponding to the region B, and grooves 50*x* for arranging the electronic components 50 are formed in the jig 100. For convenience, the grooves 50*x* are indicated by broken lines.

The grooves 30*x* and 30*y* slant by a predetermined angle relative to the groove 50*x*. Because the heights (the height H of FIG. 4) of the connecting terminals 30 are greater than the heights of the electronic components 50, the depths of the grooves 30*x* and 30*y* are greater than the depths of the grooves 50*x*. FIG. 6 is schematically illustrated for convenience. The cross-sectional view of FIG. 5 is not accurately illustrated in FIG. 6.

Figure 7:
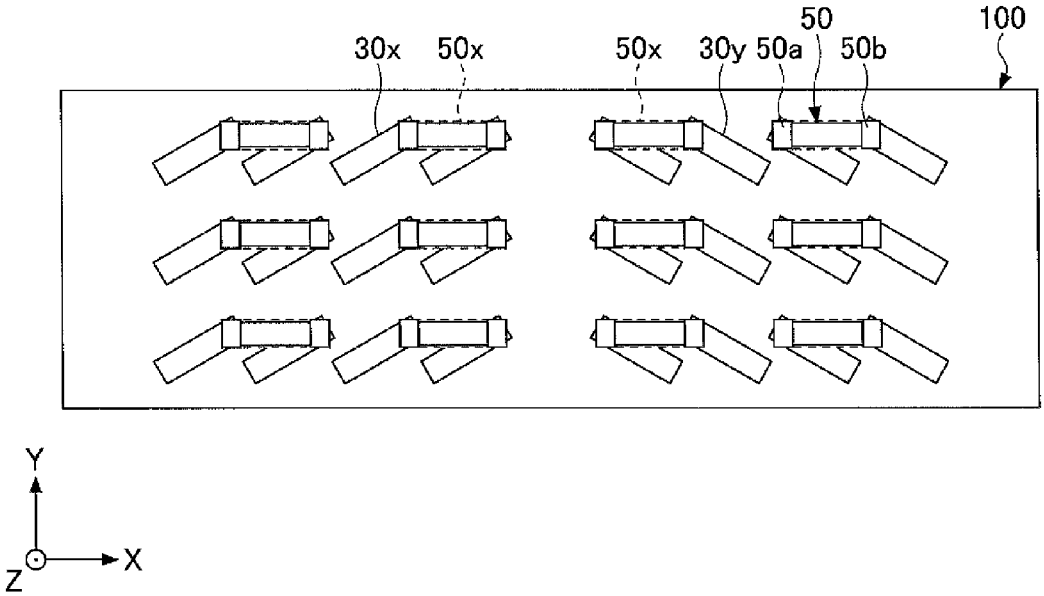
FIG. 7 illustrates a third step of the exemplary manufacturing process of the exemplary socket of the First Embodiment.
Figure 8:
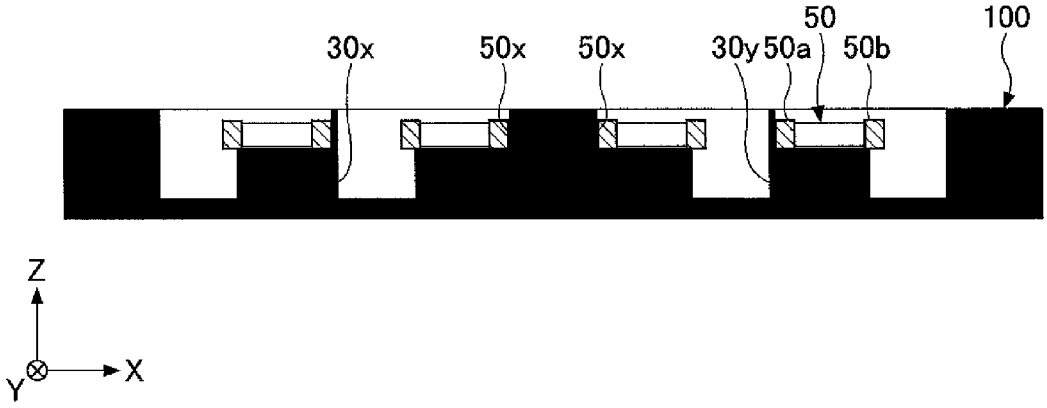
FIG. 8 illustrates a fourth step of the exemplary manufacturing process of the exemplary socket of The First Embodiment.

Next, in the processes illustrated in FIG. 7 (the plan view) and FIG. 8 (the cross-sectional view), the electronic components 50 are arranged in the grooves 50*x*.

Figure 9:
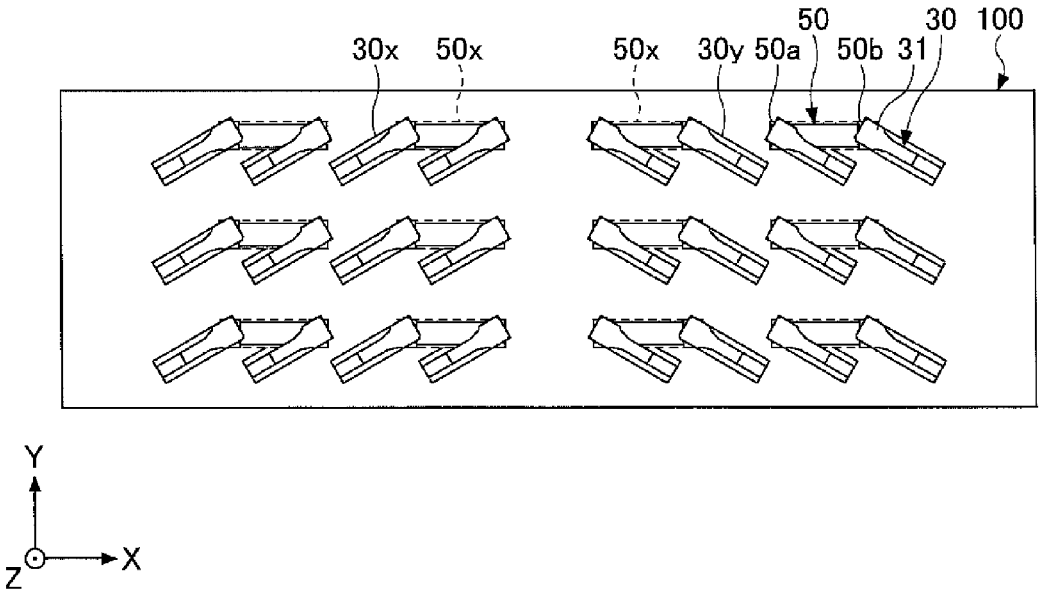
FIG. 9 illustrates a fifth step of the exemplary manufacturing process of the exemplary socket of The First Embodiment.
Figure 10:
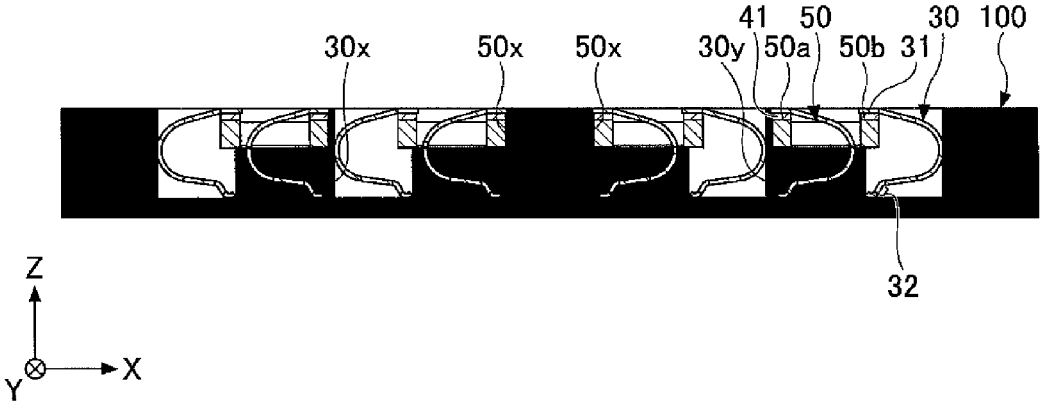
FIG. 10 illustrates a sixth step of the exemplary manufacturing process of the exemplary socket of The First Embodiment.

In the processes illustrated in FIG. 9 (the plan view) and FIG. 10 (the cross-sectional view), the joining parts 41 are formed on surfaces of the electronic components 50 exposed from the grooves 50*x* of the electrode terminals 50*a* and 50*b* of the electronic components 50. The connecting terminals 30 are made. The made connecting terminals 30 are positioned on bottom surface sides of the grooves 30*x* and 30*y*. The connecting terminals 30 are arranged on the grooves 30*x* and 30*y* so that the second faces 31*b* of the fixing parts 31 (see FIG. 4) face, via the joining parts 41, surfaces of the electrode terminals 50*a* and 50*b* of the electronic components 50 exposed from the grooves 50*x*.

The material of the joining parts 41 is a conductive material such as solder and a conductive resin paste such as an Ag paste. When the material of the joining parts 41 is solder, the solder may be, for example, an alloy containing Pb, an alloy containing Sn and Cu, an alloy containing Sn and Ag, an alloy containing Sn, Ag, and Cu, and so on. The joining parts 41 may be formed by coating a solder paste, mounting solder balls and so on.

The connecting terminals 30 may be made as follows. A metallic plate made of, for example, a Cu alloy, is prepared. The prepared metallic plate is punched out so as to have a predetermined shape. At this time, the metallic plate is punched out to be shaped like a long beam. Thereafter, a film of Ni plating having a thickness of, for example, 1 μm to 3 μm is formed on an entire surface of the punched-out metallic plate. Further, a film of Au plating having a thickness of, for example, a thickness of 0.3 μm to 0.5 μm is laminated (partly formed) on the film of Ni plating formed at positions corresponding to the fixing part 31 and the contacting part 38. Thereafter, the metallic plate on which the film of Ni plating and the film of Au plating are formed is bent.

The Cu alloy as the material of the metallic plate is, for example, phosphor bronze, beryllium copper, Corson series copper alloys and so on. The connecting terminals 30 may be formed by etching the metallic plates (e.g., plates of a Cu alloy) to have a predetermined shape (not illustrated) and bending the etched metallic plates to have a predetermined shape.

Figure 11:
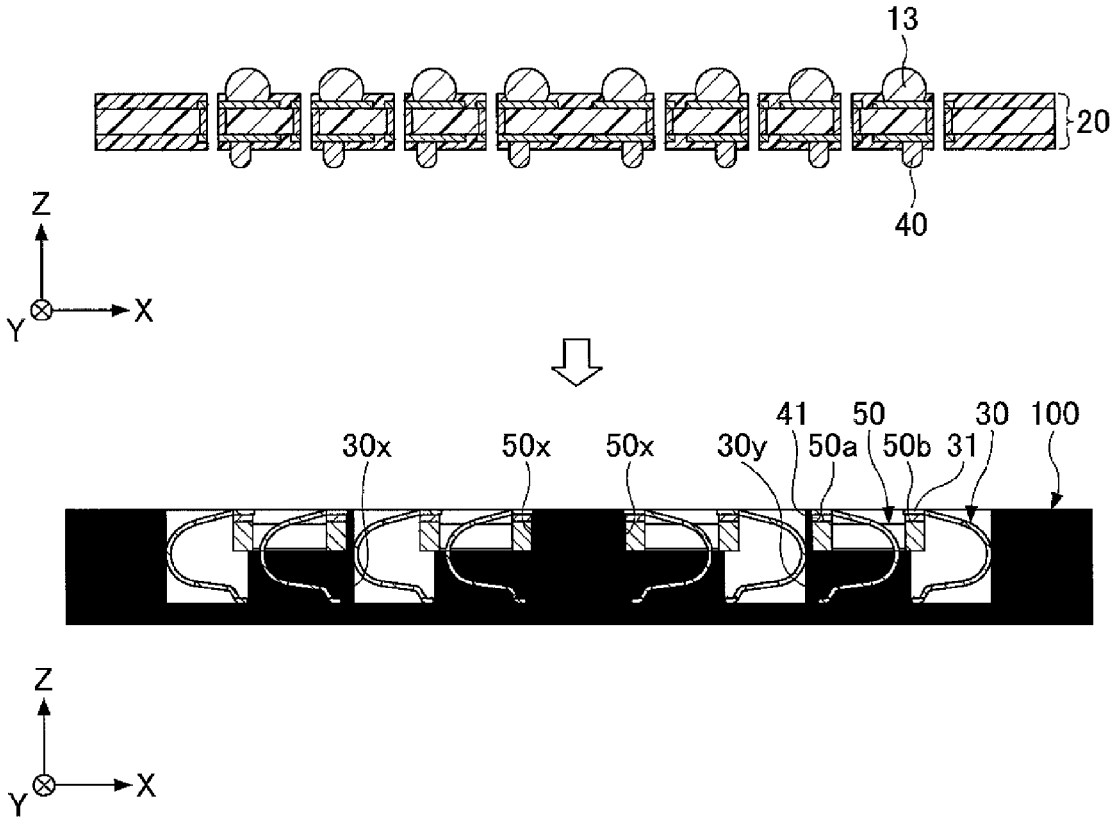
FIG. 11 illustrates a seventh step of the exemplary manufacturing process of the exemplary socket of The First Embodiment.

In the process illustrated in FIG. 11 (the cross-sectional view), the joining parts 40 are formed on (under) the first conductive layers 22, and bumps 13 are formed on (under) the second conductive layers 23. Thus, the boards 20 are prepared. The joining parts 40 are aligned to face the first faces 31*a* of the fixing parts 31 of the connecting terminals 30. Said differently, the joining parts 40 are aligned to face the joining parts 41 via the fixing parts 31. Then, the boards 20 are mounted on the jig 100. With this, the joining parts 40 are in contact with the first faces 31*a* of the fixing parts 31. For example, when the bumps made of a solder, a bond of conductive resin and so on are provided on the conductive pads 72 of the circuit board 70 without providing the bumps 13 in the socket 10, it is unnecessary to form the bumps 13 on the second conductive layers 23 of the board 20.

The materials of the joining parts 40 and the bumps 13 are a conductive material such as solder and a conductive resin paste such as an Ag paste. When the materials of the joining part 40 and the bump 13 are solder, the solder may be, for example, an alloy containing Pb, an alloy containing Sn and Cu, an alloy containing Sn and Ag, an alloy containing Sn, Ag, and Cu, and so on. The joining parts 40 and the bumps 13 may be formed by coating a solder paste, mounting solder balls and so on.

Figure 12:
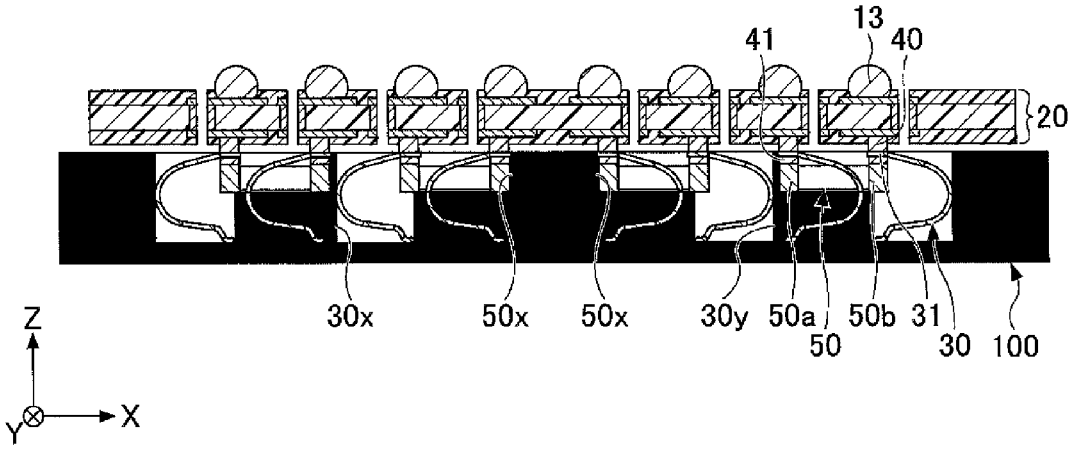
FIG. 12 illustrates an eighth step of the exemplary manufacturing process of the exemplary socket of The First Embodiment.

In the process illustrated in FIG. 12 (the cross-sectional view), the jig 100 on which the board 20 aligned so that the joining parts 40 are in contact with the first faces 31*a* of the fixing parts 31 is sent to a reflow furnace. The jig 100 including the board 20 is heated to 230° C. to thereby melt the joining parts 40, the joining parts 41 and the bumps 13 and then hardening these under an ordinary temperature. As described, the film of Ni plating is formed on the surface of the connecting terminal 30, and the film of Au plating is further laminated on the film of Ni plating in the fixing part 31. Therefore, the solder is apt to be formed only on the fixing part 31, and a probability that the solder creeps up due to its wettability on a portion in which the film of Au plating is not laminated and the film of Ni plating is exposed can be reduced.

Figure 13:
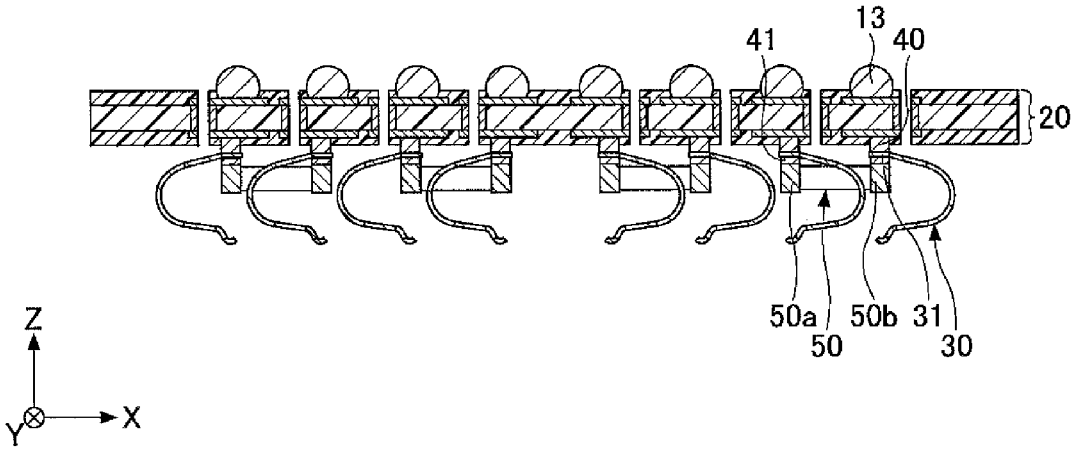
FIG. 13 illustrates a ninth step of the exemplary manufacturing process of the exemplary socket of The First Embodiment.

With the process illustrated in FIG. 13 (the cross-sectional view), the jig 100 is removed from a structural body illustrated in FIG. 12.

Figure 14:
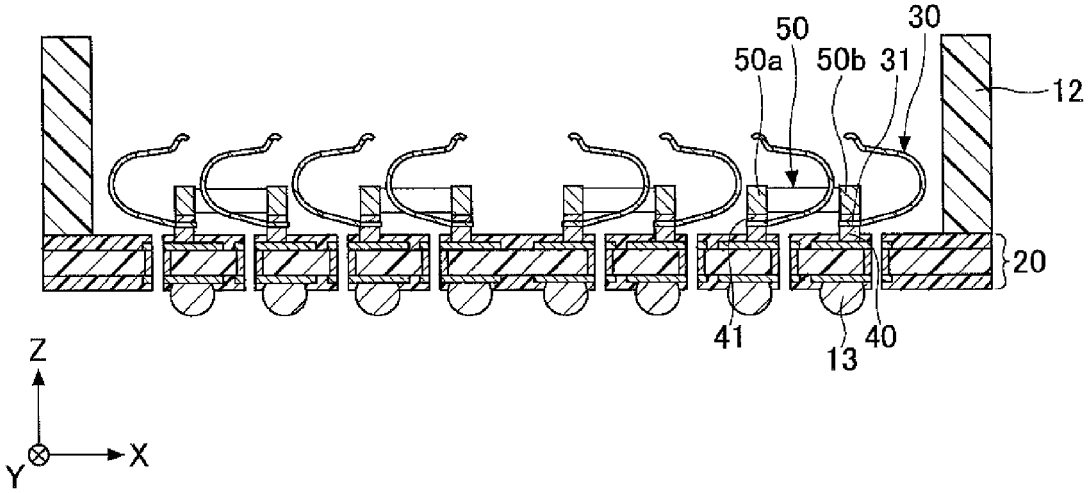
FIG. 14 illustrates a tenth step of the exemplary manufacturing process of the exemplary socket of The First Embodiment.

With the process illustrated in FIG. 14 (the cross-sectional view), the structural body illustrated in FIG. 13 is turned upside down. The positioning portion 12 is fixed by bonding and so onto the outer edges of the first solder resist layer 25 formed on the first principal face 21*a* of the main body 21 of the board 20. The positioning portion 12 has a frame-like shape (an architrave-like shape) in a plan view. For example, the primary component of the positioning portion 12 is an epoxy resin and so on. The positioning portion 12 may be mechanically fixed to the board 20 by screws and so on.

The process may not be provided if the semiconductor package 60 is positioned by the frame 81 of the casing 80 described below without providing the positioning portion 12. With the processes illustrated in FIG. 5 to FIG. 14, the socket 10 having the connecting terminal structure 11 is completed.

(Method of Using the Socket of First Embodiment)

Figure 15:
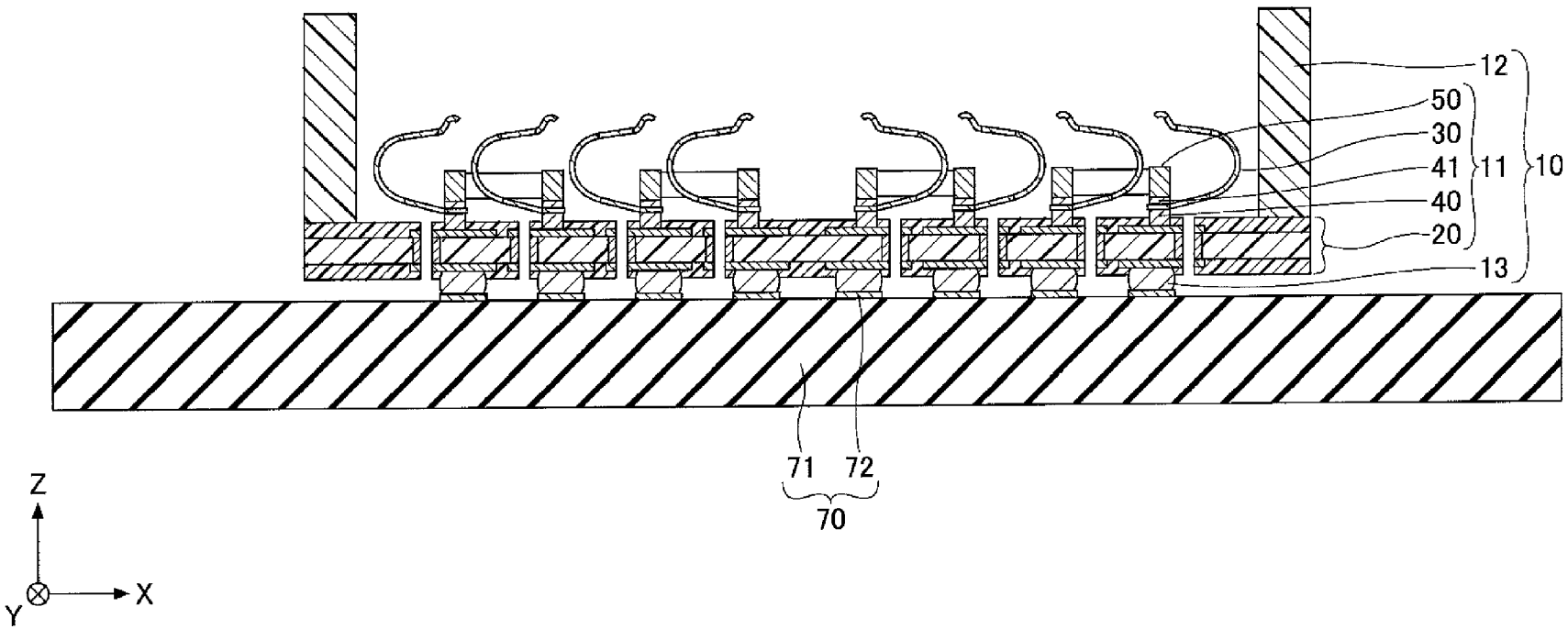
FIG. 15 illustrates a first step of an exemplary method for connecting an object to be connected to the exemplary socket of The First Embodiment.
Figure 16:
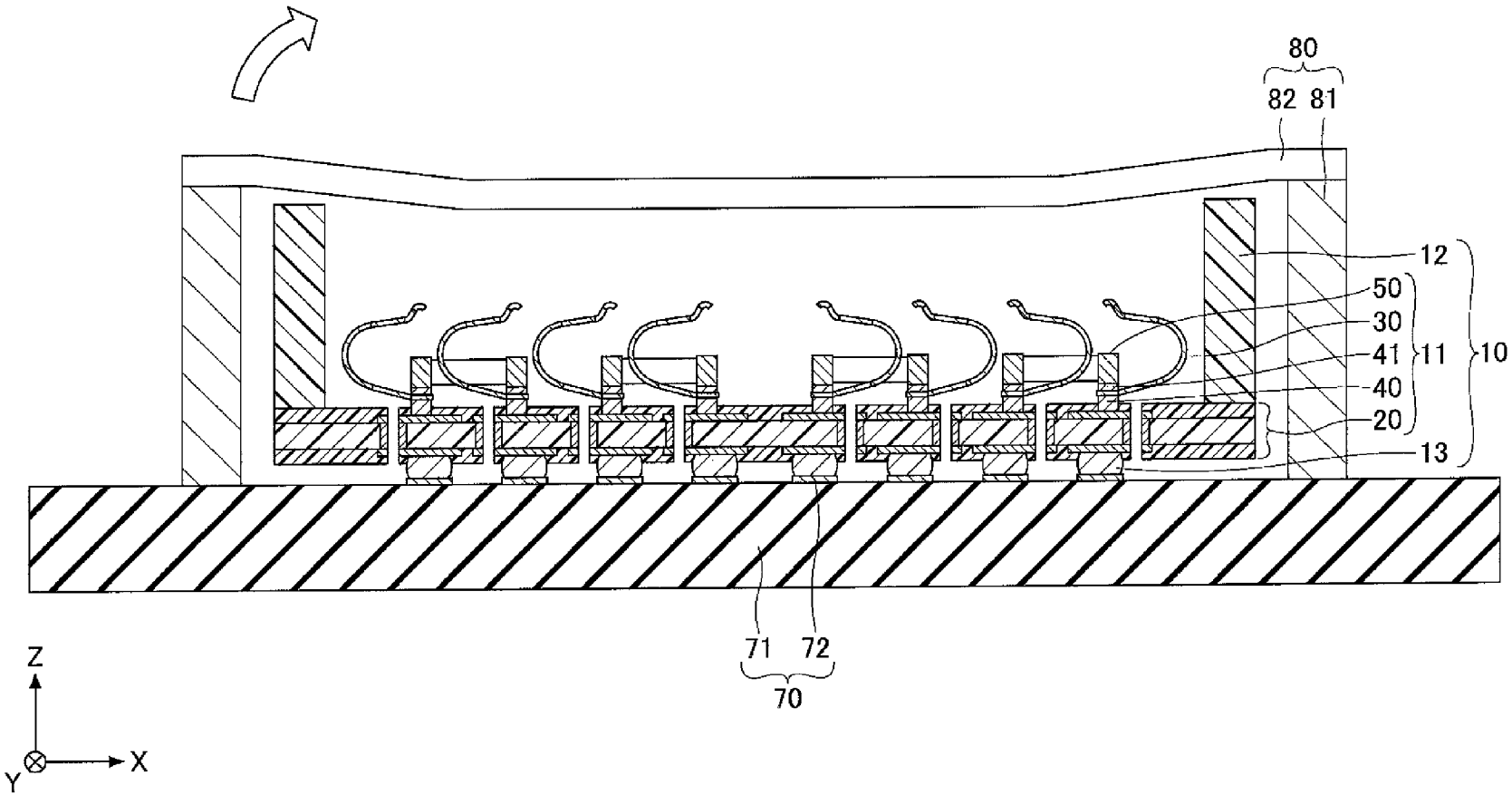
FIG. 16 illustrates a second step of the exemplary method for connecting the object to be connected to the exemplary socket of The First Embodiment.
Figure 17:
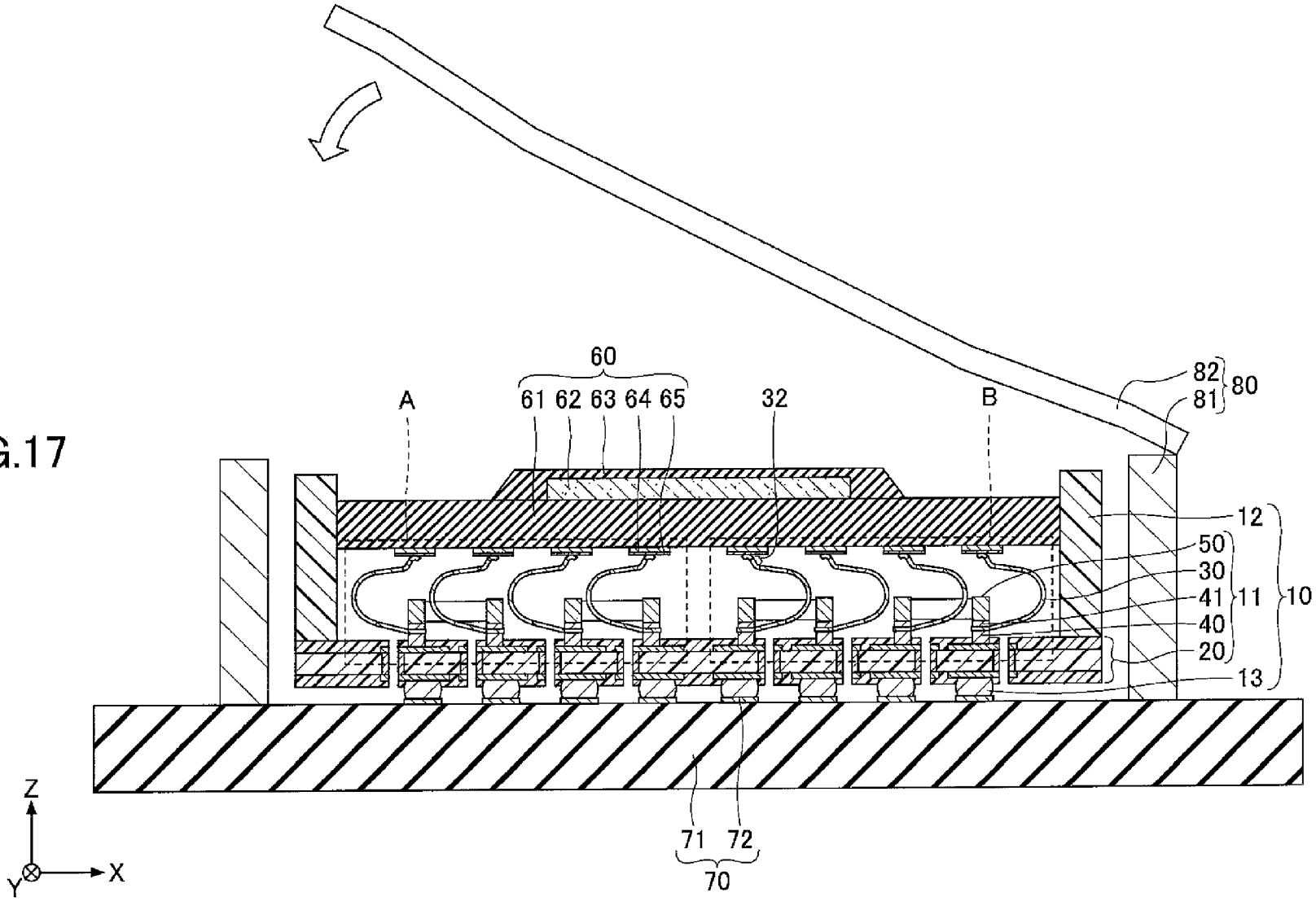
FIG. 17 illustrates a third step of the exemplary method for connecting the object to be connected to the exemplary socket of The First Embodiment.

Referring to FIG. 15 to FIG. 17, a method of connecting the semiconductor package 60 to the circuit board 70 using the socket 10 is described.

Referring to FIG. 15, the circuit board 70 and the socket 10 are prepared. The circuit board 70 is electrically and mechanically connected to the socket 10 via the bumps 13. Specifically, the conductive pads 72 of the circuit board 70 are made to be in contact with the bumps 13 of the socket 10. The bumps 13 are heated at, for example, 230° C., melted, and hardened to thereby join the circuit board 70 to the socket 10. With this, the socket 10 is electrically and mechanically connected to the circuit board 70 via the bumps 13.

Subsequently, as illustrated in FIG. 16, the casing 80 is prepared. The frame 81 of the casing 80 is fixed to the upper surface of the circuit board 70 by bolts, screws and so on (not illustrated) penetrating through the circuit board 70. Referring to FIG. 16, the lid 82 of the casing 80 is rotated in a direction of arrow so that the semiconductor package 60 can be arranged.

Referring to FIG. 17, the semiconductor package 60 is prepared. The semiconductor package 60 is inserted into the positioning portion 12 so that the side surfaces of the substrate 61 are in contact with the inner side faces of the positioning portion 12. However, at this moment, the connecting terminals 30 are not pushed with pressure by the semiconductor package 60. The semiconductor package 60 is aligned with the socket 10 by the positioning portion 12. The rare metal layers 65 of the semiconductor package 60 are in contact with the connecting parts 32 of the connecting terminals 30.

Further, the lid 82 is rotated in the arrow direction to insert the semiconductor package 60 into the circuit board 70 with force. Then, the outer edge of the lid 82 is fixed (locked) to the frame 81 so as to be in contact with the upper surface of the frame 81. With this, the connecting terminals 30 of the socket 10 are pushed with force and bent in a Z direction to generate predetermined spring force. Therefore, the rare metal layers 65 of the semiconductor package 60 are in contact with the connecting parts 32 of the connecting terminals 30. The semiconductor package 60 is electrically connected to the circuit board 70 via the socket 10 as illustrated in FIG. 1 and FIG. 2.

As described, the connecting terminal structure 11 of First Embodiment and the socket 10 having the connecting terminal structure 11 of First Embodiment have electrical components 50 such as capacitors on the fixing parts 31 of the adjacent connecting terminals 30 so that the electrical components 50 are not in contact with the substrate 61, the board 20, or the circuit board 70. Therefore, the impedances of the wirings via the connecting terminals 30 can be reduced to stabilize power supplied from the power source.

Further, the lengths of the wirings from the semiconductor package 60 as the object to be connected to the electronic components 50 can be reduced. Furthermore, because an additional wiring for mounting the electronic components 50 does not exist, corresponding inductance and resistance do not additionally occur. With this, transmission capability of a high speed signal between the semiconductor package 60 as the object to be connected and the circuit board 70 such as a motherboard can be improved.

Even if the electronic components 50 are mounted on the fixing parts 31 of the adjacent connecting terminals 30, the overall height (the overall thickness) of the socket 10 remains unchanged thereby not spoiling the low height profile of the socket 10 having the electronic components 50.

Furthermore, because the capacitors as the electronic components 50 can be mounted on the fixing parts 31 of the adjacent connecting terminals 30 with a simple structure, the manufacturing cost of the socket 10 can be prevented from increasing.

Modified Example of Embodiment 1

With the First Embodiment, the example of providing the positioning portion 12 on the board 20 and aligning the semiconductor package 60 with the positioning portion 12 is described. With a modified example of the First Embodiment, the positioning portion 12 is not provided on the board 20 and the function of the positioning portion 12 is given to the frame of the casing 80 to align the semiconductor package 60.

Figure 18:
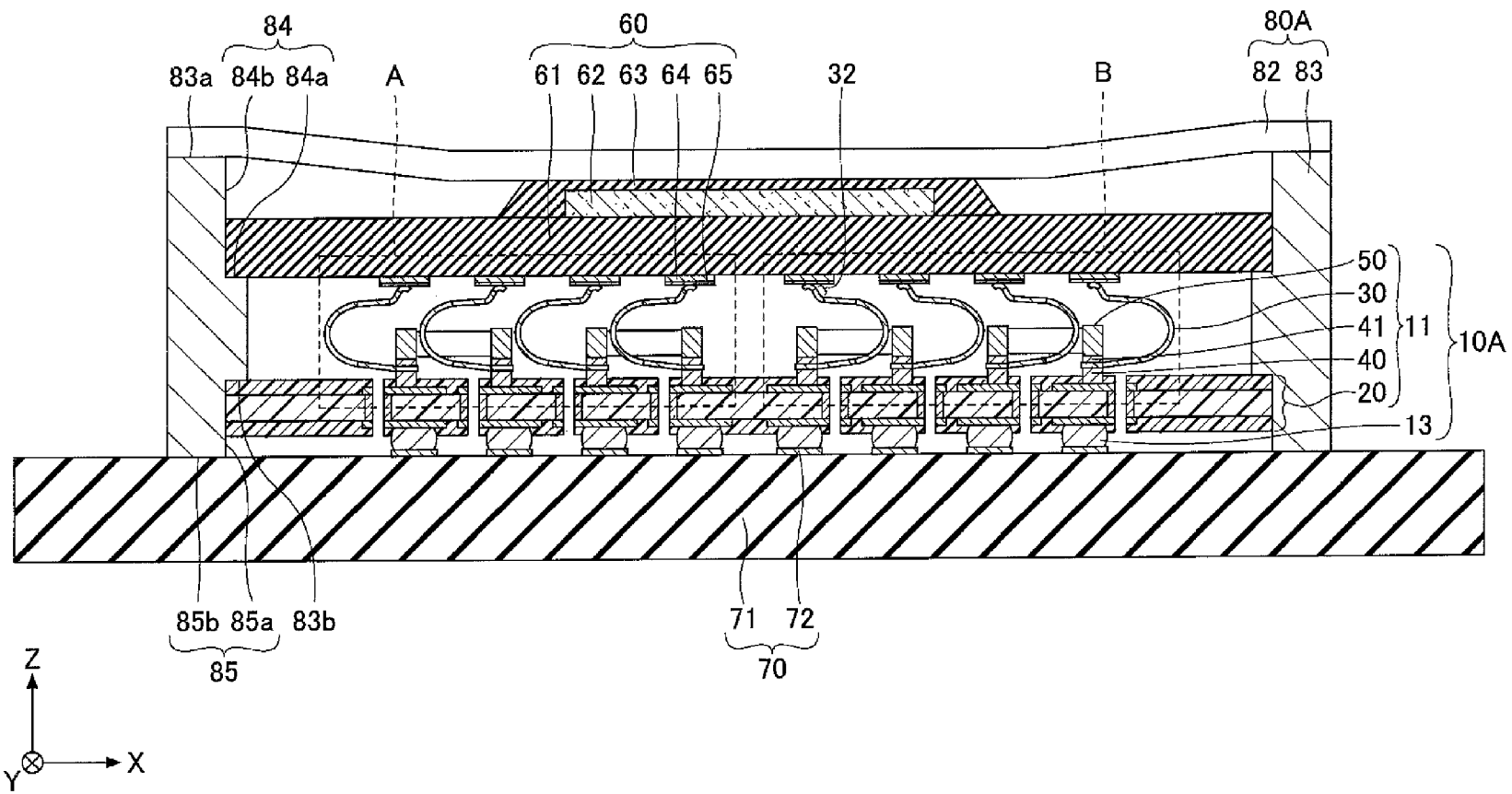
FIG. 18 is a cross-sectional view of the exemplary socket of The First Embodiment.

FIG. 18 is a cross-sectional view of a socket 10A of the modified example of the First Embodiment. Referring to FIG. 18, differences from the socket 10 (see FIG. 1 and FIG. 2) of the First Embodiment are that the positioning portion 12 is not provided on the board 20 and a frame 83 of a casing 80A is provided to align the semiconductor package 60. Hereinafter, descriptions of the same constituent parts as those in the First Embodiment are omitted, and different portions are mainly described.

Figure 19A:
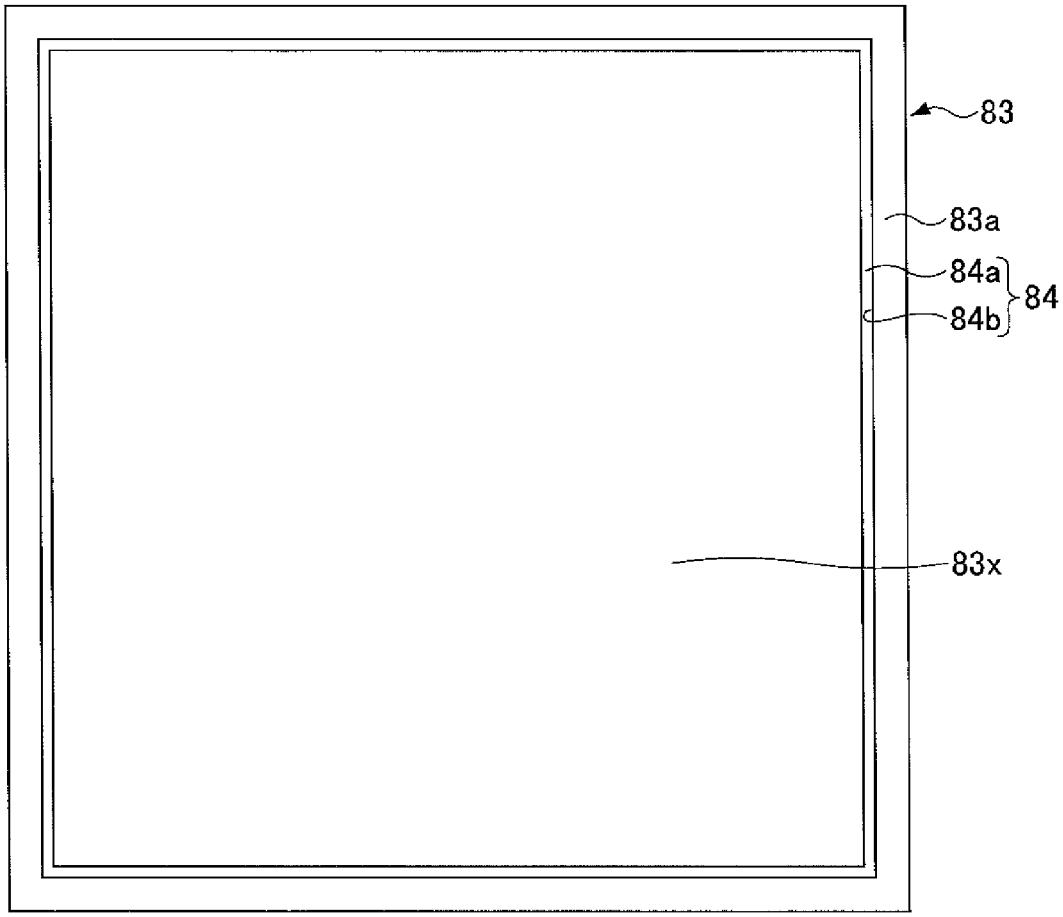
FIG. 19A is a plan view illustrating a frame of a casing of a modified example of The First Embodiment.
Figure 19B:
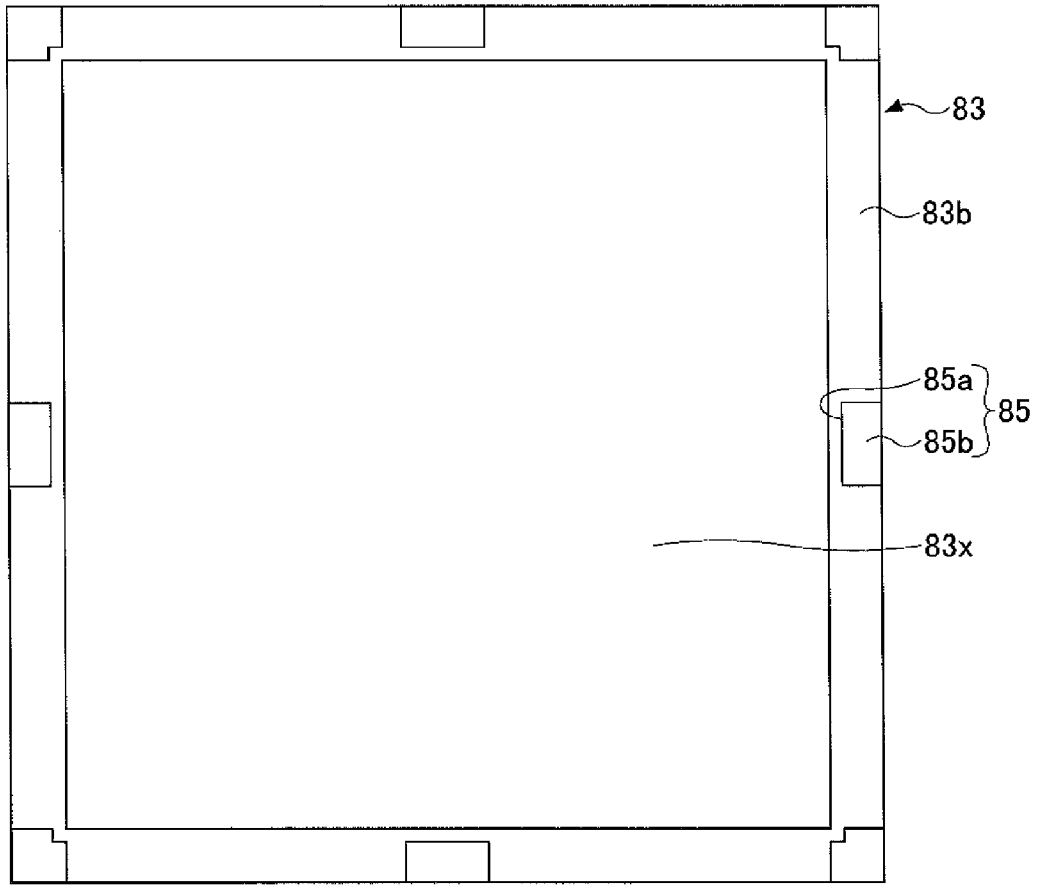
FIG. 19B is a bottom plan view illustrating the frame of the casing of the modified example of The First Embodiment.
Figure 19C:
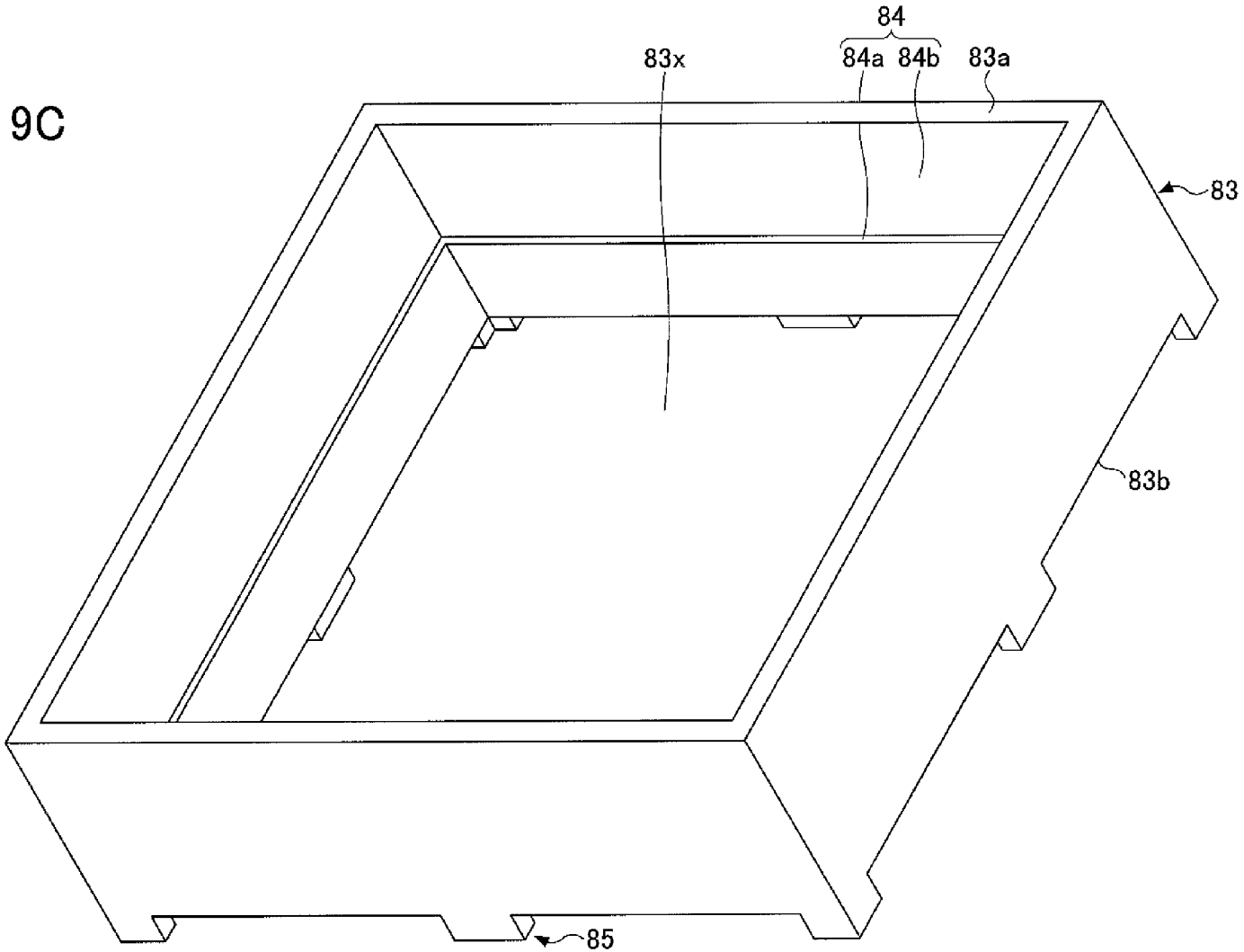
FIG. 19C is a perspective view illustrating the frame of the casing of the modified example of The First Embodiment.

FIG. 19A to FIG. 19C illustrate the frame 83 of the casing 80A of the modified example of the First Embodiment. FIG. 19A is a plan view, FIG. 19B illustrates a bottom surface, and FIG. 19C is a perspective view. Referring to FIG. 19A to FIG. 19C, the frame 83 is a member of a frame-like shape (an architrave-like shape) having a rectangular opening portion 83*x* in which a first positioning and holding portion 84 and a second positioning and holding portion 85 are formed. The frame 83 is made of a resin, a metal and so on. The frame 83 aligns and holds the semiconductor package 60 and the board 20 to position the semiconductor package 60 and the board 20. Further, the frame 83 has a function of preventing a gap between the semiconductor package 60 and the board 20 from being a predetermined value or less.

The first positioning and holding portion 84 has a face 84*a* and a face 84*b*. The face 84*a* is shaped like a frame or an architrave. The face 84*a* is positioned inside an upper face 83*a* of the frame 83, one step inside of the upper face 83*a*, and substantially parallel to the upper face 83*a*. The face 84*b* is provided perpendicular to the face 83*a* and between the face 84*a* and the upper face 83*a*. The face 84*a* constitutes a part of the inner side face of the frame 83.

The face 84*b* is in contact with the outer edge of the lower surface of the substrate 61 of the semiconductor package 60. The shape of the opening portion formed by the faces 84*b* is rectangular in conformity with the plan view of the semiconductor package 60. Further, the shape of the opening portion formed by the faces 84*b* is slightly greater than the outer shape of the substrate 61 to enable attaching and detaching the semiconductor package 60. The face 84*b* may be in contact with the side surface of the substrate 61. Alternatively, a gap may be provided as long as a positional shift does not occur between the connecting parts 32 of the connecting terminal 30 of the socket 10A and the rare metal layers 65 of the semiconductor package 60.

Since the package is held by the first positioning and holding portion 84, the semiconductor package 60 is not pushed on the side of the circuit board 70 over the surface 84*a* of the first positioning and holding portion 84. As a result, it is possible to prevent the semiconductor package 60 from being excessively pushed on the side of the circuit board 70 thereby avoiding excessive deformation of the connecting terminals 30 and resultant damage of the connecting terminals 30.

The plural second positioning and holding portions 85 are protrusions provided in outer edges of a lower surface 83*b* of the frame 83. The second positioning and holding portions 85 have inner side faces 85*a* and bottom faces 85*b*. The board 20 is inserted with force among the plural second positioning and holding portions 85. The lower surfaces 83*b* and the inner side faces 85*a* of the plural second positioning and holding portions 85 are in contact with the outer edges of the upper faces and the side surfaces of the board 20.

The shape of the opening portion formed by the inner side faces 85*a* is rectangular in conformity with the plan view of the board 20. Further, the shape of the opening portion formed by the inner side face 85*a* is substantially the same as the outer shape of the board 20 to enable inserting the board into the opening portion with force (press fit). The heights of the lower surfaces 83*b* from the bottom faces 85*b* of the second positioning and holding portions 85 are substantially the same as the height (distance) of the upper surface of the board 20 from the upper surface of the circuit board 70. The bottom faces 85*b* of the second positioning and holding portions 85 are in contact with the upper surfaces of the circuit board 70.

Even though the frame 83 is not fixed to the circuit board 70, the socket 10A fixed to the circuit board 70 by the bumps 13 indirectly causes the frame 83, into which the board 20 is inserted with force (press fit), to be fixed to the circuit board 70. However, the frame 83 may be fixed to the upper surface of the circuit board 70 by bolts, screws and so on penetrating through the circuit board 70 instead of the structure of indirectly fixing the frame 83 to the circuit board 70.

With the modified example of the First Embodiment, effects similar to those in the First Embodiment are obtainable. Further, the following effects are obtainable. By giving a positioning function to the frame 83 of the casing 80A, the semiconductor package 60 as the object to be connected may be properly positioned.

Then, a gap between the semiconductor package or the like as the object to be connected and the board 20 does not become a predetermined value or less to thereby prevent the semiconductor package or the like from being excessively pushed on the side of the circuit board 70 where excessive deformation of the connecting terminals 30 and the resultant damage of the connecting terminals 30 can be prevented.

Second Embodiment

With a Second Embodiment, a semiconductor package 60A having a connecting terminal structure 11A is exemplified. Detailed explanation of the same constituent elements as those in the First Embodiment is omitted.

Figure 20:
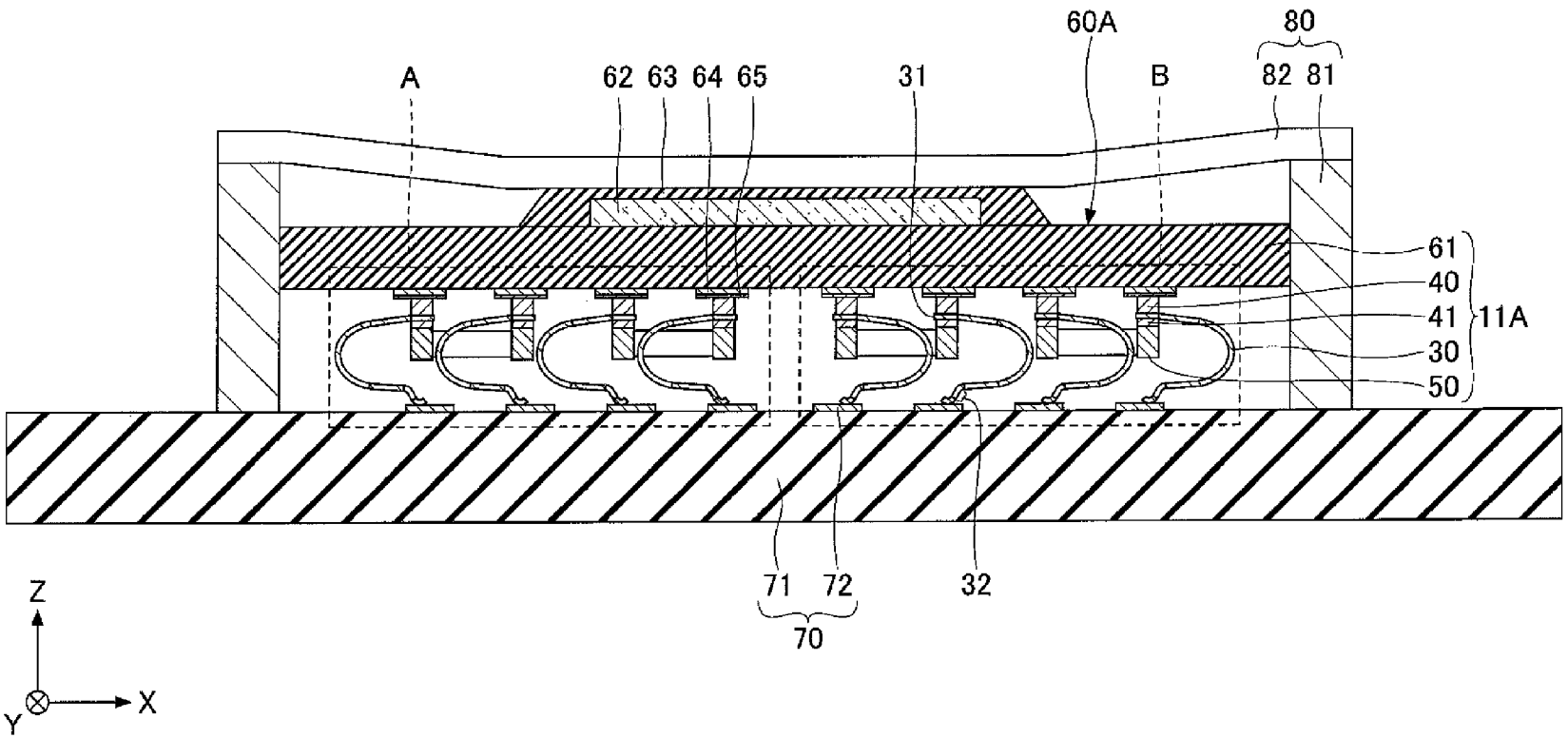
FIG. 20 is a cross-sectional view of a semiconductor package of Second Embodiment.

FIG. 20 is a cross-sectional view of the semiconductor package 60A of the Second Embodiment. Referring to FIG. 20, the semiconductor package 60A includes the connecting terminal structure 11A, a semiconductor chip 62, sealing resin 63, a conductive layer 64, and a rare metal layer 65. The connecting terminal structure 11A includes a substrate 61, connecting terminals 30, joining parts 40, joining parts 41 and electronic components 50. A solder resist layer may be provided to expose the surface of the rare metal layer 65 on (under) the surface of the substrate 61.

In the connecting terminal structure 11A, fixing parts 31 as first ends of the connecting terminals 30 are electrically and mechanically connected to the rare metal layers (pads) 65 formed on (under) the substrate 61 via the joining parts 40. Connecting parts 32 as the other ends of the connecting terminals 30 are in contact with conductive pads 72 of a circuit board 70 so as to be separable from conductive pads 72 (an unfixed state). Thus, the connecting parts 32 of the connecting terminals 30 are electrically in contact with the conductive pads 72 of the circuit board 70. Rare metal layers similar to the rare metal layers 65 may be formed on the conductive pads 72.

As described, the connecting terminal structure 11A is formed so that the board 20 of the connecting terminal structure 11 in the First Embodiment is replaced by the substrate 61 which is one of the constituent elements of the semiconductor package 60A. Said differently, the connecting terminal structure 11A is arranged on (under) a surface opposite to a surface on which the semiconductor chip of the semiconductor package 60A is mounted. A frame 81 of a casing 80 is fixed to the upper surface of the circuit board 70 by bolts, screws or the like (not illustrated) penetrating the circuit board 70. By rotating a lid 82 of the casing 80 in a similar manner to that of the First Embodiment, the semiconductor package 60A can be attached or detached.

With the Second Embodiment, effects similar to those in the First Embodiment are obtainable. Further, the following effects are obtainable. Said differently, by providing the connecting terminal structure 11A of the Second Embodiment in the semiconductor package 60A, it is possible to easily attach or detach the semiconductor package 60A to or from a circuit board such as a motherboard.

Further, with the First Embodiment and the modified example of the First Embodiment, the connecting terminals 30 may be provided on both surfaces of the board 20. The connecting terminals 30 on one surface of the board 20 may be connected to the semiconductor package 60, and the connecting terminals 30 on the other surface of the board 20 may be connected to the circuit board 70. With the structure, the board 20 can be attached to and detached from the circuit board 70 without being fixed to the circuit board 70. Thus, when the connecting terminals 30 are damaged, the board 20 can be replaced by a new board having normal connecting terminals 30. In this case, the electronic components 50 can be mounted on both surfaces of the board 20. Therefore, if the capacitors are mounted as the electronic components 50, the capacity of the capacitors can be greatly increased.

With the First Embodiment and the modified example of the First Embodiment, the socket of the First Embodiment or the modified example of the First Embodiment is applied to the circuit board such as a motherboard. However, the socket of the First Embodiment or the modified example of the First Embodiment may be applicable to a test board for a semiconductor package. For example, if the socket of the First Embodiment or the modified example of the First Embodiment is applied to a test board for semiconductor packages, it becomes possible to repeat tests of electric characteristics and so on of the semiconductor packages.

As described, it is possible to provide the connecting terminal structure capable of reducing impedances of wirings via connecting terminals with a simple structure, a manufacturing method of the connecting terminal structure, and the socket which has the connecting terminal structure and electrically connecting the object to be connected such as a semiconductor package to the circuit board.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A connecting terminal structure comprising:

a board including first pads formed on a surface of the board;

a plurality of pairs of connecting terminals, each of the connecting terminals including a connecting part, which is provided to contact an object to be connected and is provided at an end of the connecting terminal, and a plate-like fixing part, which is provided at another end of the connecting terminal, the plate-like fixing part having a first face and a second face, which is provided on a side of the plate-like fixing part opposite to another side of the plate-like fixing part where the first face is provided and which faces the connecting part; and a plurality of electronic components, each of the electronic components including at least two electrode terminals, wherein the first face of each of the plate-like fixing parts is connected to a corresponding first pad included in the first pads on the surface of the board, wherein the second face of each of the plate-like fixing parts of each pair of connecting terminals is connected to a corresponding electrode terminal included in the electrode terminals, which are included in a corresponding electronic component among the plurality of electronic components, and wherein when vertically viewed from the connecting part to the plate-like fixing part, the connecting terminals of each pair are parallelly arranged in a direction and the corresponding electronic component is arranged in another direction different from the direction.

2. The connecting terminal structure according to claim 1, wherein longitudinal directions of the connecting terminals slant relative to directions connecting two of the electrode terminals of the electronic components in a plan view of the connecting terminal structure.

3. The connecting terminal structure according to claim 1, wherein each of the connecting terminals further includes a spring part between the connecting part and the fixing part.

4. The connecting terminal structure according to claim 1, wherein the board further includes through holes penetrating through a surface of the board to an opposite surface of the board;

second pads formed on the opposite surface; and wirings configured to electrically connect the first pads with the second pads via the through holes.

5. The connecting terminal structure according to claim 4, further comprising:

bumps formed on the second pads.

6. The connecting terminal structure according to claim 4, wherein the board is a substrate of a semiconductor package, and a semiconductor chip is mounted on the opposite surface of the board.

7. A socket comprising:

the connecting terminal structure according to claim 4; and a circuit board electrically connected to the board on the opposite surface of the board, wherein the object to be connected is electrically connectable to the circuit board via the connecting terminals and the board, and the object to be connected is attachable to or detachable from the socket.

8. The socket according to claim 7, further comprising:

a positioning part configured to position the object to be connected relative to the connecting parts is provided at outer edges of the surface of the board.

* * * * *